US008413866B2

(12) United States Patent
Cooper et al.

(10) Patent No.: US 8,413,866 B2
(45) Date of Patent: Apr. 9, 2013

(54) DEVICE FOR DISPENSING PLASTIC FASTENERS

(75) Inventors: William J. Cooper, Woonsocket, RI (US); John Earley, Northboro, MA (US); Jeffrey A. Raymond, Leominster, MA (US); Shaoming Liu, Shenzhen (CN)

(73) Assignee: Avery Dennison Corporation, Pasadena, CA (US)

( * ) Notice: Subject to any disclaimer, the term of this patent is extended or adjusted under 35 U.S.C. 154(b) by 139 days.

(21) Appl. No.: 11/978,892

(22) Filed: Oct. 30, 2007

(65) Prior Publication Data

US 2008/0164271 A1 Jul. 10, 2008

Related U.S. Application Data

(63) Continuation-in-part of application No. 11/593,452, filed on Nov. 6, 2006, now abandoned.

(51) Int. Cl.
*A43D 11/01* (2006.01)

(52) U.S. Cl. ..... 227/67; 227/68

(58) Field of Classification Search ..... 227/67, 227/107, 154; 173/1; 206/338
See application file for complete search history.

(56) References Cited

U.S. PATENT DOCUMENTS 4,039,078 A 8/1977 Bone
4,268,783 A * 5/1981 Murray ..... 318/565
4,461,738 A * 7/1984 Russell ..... 264/145
4,714,867 A * 12/1987 Palmin et al. ..... 318/696
4,790,225 A * 12/1988 Moody et al. ..... 83/100
4,877,172 A 10/1989 Franklin et al.
5,433,366 A * 7/1995 Deschenes et al. ..... 227/67
5,518,228 A * 5/1996 Bodie et al. ..... 270/58.11
5,598,940 A * 2/1997 Finkelstein et al. ..... 215/348
5,615,816 A 4/1997 Deschenes et al.
5,800,322 A * 9/1998 Block ..... 482/126
5,809,877 A * 9/1998 Szyszko et al. ..... 101/123
6,047,823 A * 4/2000 Deschenes et al. ..... 206/338
2005/0023747 A1 * 2/2005 Dunlap et al. ..... 271/275

* cited by examiner

*Primary Examiner* — M. Alexandra Elve
*Assistant Examiner* — Nathaniel Chukwurah
(74) *Attorney, Agent, or Firm* — Kriegsman & Kriegsman

(57) ABSTRACT

A device for dispensing individual plastic fasteners from a continuous supply of 0.1875 inch pitch ladder stock includes a head assembly that is designed to receive the supply of ladder stock, sever an individual fastener from the supply ladder stock and eject the individual fastener during a single stroke of its actuation cycle. The device also includes a stepper motor for driving the head assembly through its actuation cycle, a DC power switching supply for regulating the power supplied to the stepper motor from an AC input power source, and a controller for collecting historical data relating to usage of the device and for regulating operation of the stepper motor. The controller is programmed to enable certain operational characteristics, such as stroke speed and mode, to be regulated through a user interface which includes a screen display and a plurality of control buttons.

22 Claims, 17 Drawing Sheets

DEVICE FOR DISPENSING PLASTIC FASTENERS

CROSS-REFERENCE TO RELATED APPLICATIONS

The present application is a continuation-in-part of U.S. patent application Ser. No. 11/593,452, filed Nov. 6, 2006 now abandoned, the disclosure of which is incorporated herein by reference.

BACKGROUND OF THE INVENTION

The present invention relates generally to plastic fasteners and more particularly to devices used in the dispensing of plastic fasteners.

In U.S. Pat. No. 4,039,078 to A. R. Bone, which is incorporated herein by reference, there are disclosed several different types of plastic fasteners (also commonly referred to in the art as plastic attachments). Each plastic fastener described in the patent is manufactured in an H-shaped configuration, with two shortened parallel cross-bars, or T-bars, being interconnected at their approximate midpoints by a thin, flexible filament which extends orthogonally therebetween. Each type of plastic fastener represented in the patent is shown as being fabricated as part of continuously connected ladder stock. In each instance, the ladder stock is formed from two elongated and continuous plastic side members, or rails, which are coupled together by a plurality of plastic cross-links, or filaments, the cross-links preferably being equidistantly spaced. The stock may be produced from flexible plastics material including nylon, polypropylene and other similar materials using conventional molding or stamping techniques. Ladder stock of the type described above is presently manufactured and sold by Avery Dennison™ Corporation of Pasadena, Calif. under the Plastic Staple® and Elastic Staple™ lines of plastic fasteners.

Ladder stock of the type described above is commonly wound onto a reel, or spool, which is sized and shaped to hold a supply of ladder stock that includes approximately 25,000 fasteners. In this manner, the reel can be used by a machine to continuously dispense a large quantity of individual fasteners, as will be described in detail below.

Either manually or with the aid of specifically designed devices, individual fasteners may be severed and dispensed from a supply of ladder stock to couple buttons to fabric, merchandising tags to articles of commerce, or, in general, any two desired articles.

Specifically designed devices for dispensing plastic fasteners are well known in the art. One well-known device for dispensing individual plastic fasteners from a reel of ladder-type fastener stock includes a pair of hollow needles which are adapted to penetrate through a particular item, a feed mechanism for advancing each rail of the supply of ladder stock into axial alignment behind the longitudinal bore defined by a corresponding hollow needle, a severing mechanism for severing a fastener to be dispensed through the pair of hollowed needles from the remainder of the ladder stock, and an ejection mechanism for ejecting the cross-bars of the severed fastener through the bores of the pair of hollowed needles and, in turn, through the particular item which is penetrated by the needles.

For example, in commonly assigned U.S. Pat. No. 5,433,366, which is incorporated herein by reference, there is disclosed a device for dispensing plastic attachments of the type which are formed as part of a roll of continuously connected ladder stock. In one embodiment, the device includes a pair of hollow slotted needles each having a tip, a rear end and a longitudinal axis. A feed wheel, placed proximate to the rear ends of the pair of needles, is used to feed individual attachments of a roll of ladder stock into the pair of needles through their respective rear ends at angles relative to the longitudinal axes thereof. Once inserted into the needles, an attachment is severed from the remainder of the ladder stock by a knife and is then expelled from the needles by a pair of ejector rods movable along the longitudinal axes of the pair of needles. Because attachments are fed into the pair of needles at angles relative to their longitudinal axes, no shuttling of the needles between an attachment feeding position and an attachment ejecting position is required. The pair of needles, the feed wheel, the knife, and the pair of ejector rods are all mounted on a vertically movable head member. An induction motor is used to move the head member between an attachment dispensing position and a withdrawal position. The vertical movement of the head member drives the operation of the feed wheel, the knife and the ejector rods.

Examples of some plastic fastener dispensing devices which are presently available in commerce are manufactured and sold by Avery Dennison™ Corporation of Pasadena, Calif. under the following names: the ST9000™, the Elastic Staple™ Single Needle System (SNS), the Elastic Staple™ Variable Needle System (VNS) and the Elastic Staple™ Single Needle System (SNS) Module.

As noted above, devices for dispensing plastic fasteners of the type described above are designed to cut the opposing rails of a supply of ladder stock at equidistant intervals to generate a plurality of individual plastic fasteners. The specific fixed distance, or spacing, between successive cuts in the rails of the ladder stock (i.e., the length of the cross-bar of each dispensed plastic fastener) is commonly referred to in the art as the pitch in which the device operates. As can be appreciated, each fastener dispensing device is typically designed to sever and eject plastic fasteners from a supply of ladder stock at a fixed pitch of 0.25 inches.

Although well known in the art, it has been found that fastener dispensing devices of the type described above suffer from some notable shortcomings.

As a first shortcoming, fastener dispensing devices of the type described above traditionally operate as a single stroke machine. Stated another way, activation of the device (e.g., through the depression of an actuation pedal) results in the ejection of a single plastic fastener. However, it has been found that certain applications require that a plurality of fasteners be dispensed in a rapid fire manner (e.g., whiskering applications in the jeans industry). Due to the inherent limitations associated with a single stroke machine, the plurality of fasteners can only be dispensed by repeatedly actuating the machine, which is a time-consuming and labor intensive process.

As a second shortcoming, fastener dispensing machines of the type described above operate at a fixed stroke speed of approximately 0.50 seconds/stroke. However, this stroke speed has been found to be unnecessarily slow when the device is used to dispense plastic fasteners through relatively thin materials. As a result, the productivity that is achieved using such a machine is limited.

As a third shortcoming, fastener dispensing machines of the type described above are not energy efficient. Specifically, the induction motor for the device requires a continuous supply of AC power which in turn renders the machine inefficient from a power consumption standpoint.

As a fourth shortcoming, fastener dispensing machines of the type described above are designed to receive a specified input voltage. Because electrical outlets in different countries provide different output voltages, each fastener dispensing machine is only available for use in selected locations, thereby limiting its usage.

As a fifth shortcoming, fastener dispensing machines of the type described above are stand alone devices (i.e., not linked with a computer). As a result, no computerized means are afforded to track and analyze historical information relating to usage of the device (e.g., quantity of fasteners dispensed, actuation rate per hour, etc.).

SUMMARY OF THE INVENTION

It is an object of the present invention to provide a new and improved device for dispensing a plastic fastener from a supply of fastener stock, the fastener stock being shaped to include an elongated and continuous side rail to which are coupled a plurality of equidistantly spaced filaments.

It is another object of the present invention to provide a device as described above which is adapted to dispense a plurality of plastic fasteners from the supply of fastener stock using a single actuation step.

It is yet another object of the present invention to provide a device as described above wherein the rate in which each fastener is dispensed can be varied according to the particular application.

It is still another object of the present invention to provide a device as described above which is energy efficient yet designed to maximize productivity.

It is yet still another object of the present invention to provide a device as described above which allows for the monitoring of historical information relating to its usage.

It is another object of the present invention to provide a device as described above which can receive power from different voltage power sources.

It is yet still another object of the present invention to provide a system as described above which has a limited number of parts, which is easy to use and which is inexpensive to manufacture.

Accordingly, as one feature of the present invention, there is provided a device for dispensing an individual plastic fastener from a supply of fastener stock, the fastener stock being shaped to include a pair of continuous side rails to which are coupled a plurality of equidistantly spaced cross-links, the individual fastener comprising a pair of shortened cross-bars that are interconnected by a flexible filament, the device comprising (a) a head assembly adapted to receive the supply of fastener stock, sever an individual fastener from the supply fastener stock and eject the individual fastener during a single stroke of its actuation cycle, (b) a stepper motor for driving the head assembly through its actuation cycle, and (c) an electronic controller for regulating the operation of the stepper motor.

As another feature of the present invention, there is provided a fastener comprising (a) a first cross-bar, (b) a second cross-bar, and a flexible filament extending transversely between the first and second cross-bars, the flexible filament comprising a first end formed onto the first cross-bar and a second end formed onto the second cross-bar, (d) wherein the first end of the filament is branched.

Various other features and advantages will appear from the description to follow. In the description, reference is made to the accompanying drawings which form a part thereof, and in which is shown by way of illustration, various embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
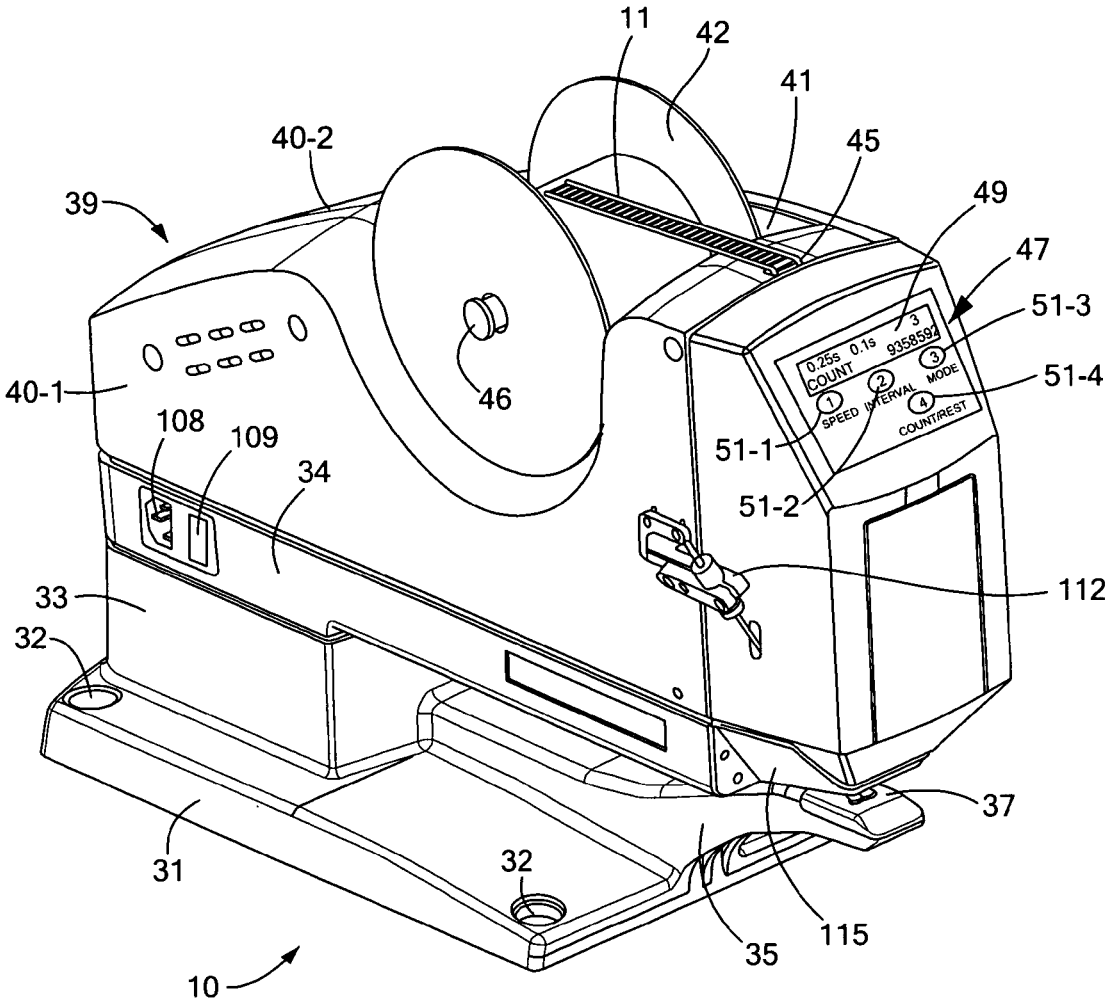
FIG. 1 is a left side perspective view of a fastener dispensing device which has been constructed according to the teachings of the present invention, the fastener dispensing device being shown with a reel of continuously connected fastener stock mounted thereon and fed thereinto.

Referring now to FIG. 1, there is shown a device for dispensing individual plastic fasteners from a supply of continuously connected ladder stock, said device being constructed according to the teachings of the present invention and identified generally by reference numeral 10. As can be appreciated, device 10 can be used in an automated packaging line, for example, to secure together two or more products, such as socks, gloves, towels or other similar items, using one or more plastic fasteners from ladder stock. For simplicity and clarity, parts not directly pertaining to the invention are only diagrammatically shown in the drawings and are not described in detail below.

Continuous Supply of Ladder Stock 11

As noted above, device 10 is designed to dispense individual plastic fasteners from various types of continuously connected ladder stock. For example, the supply of ladder stock (also referred to herein as fastener stock) may be of the type described in U.S. Pat. No. 4,039,078 to A. R. Bone or of the type described in U.S. Pat. No. 5,615,816 to C. L. Deschenes et al., both of said patents being incorporated herein by reference.

Figure 2:
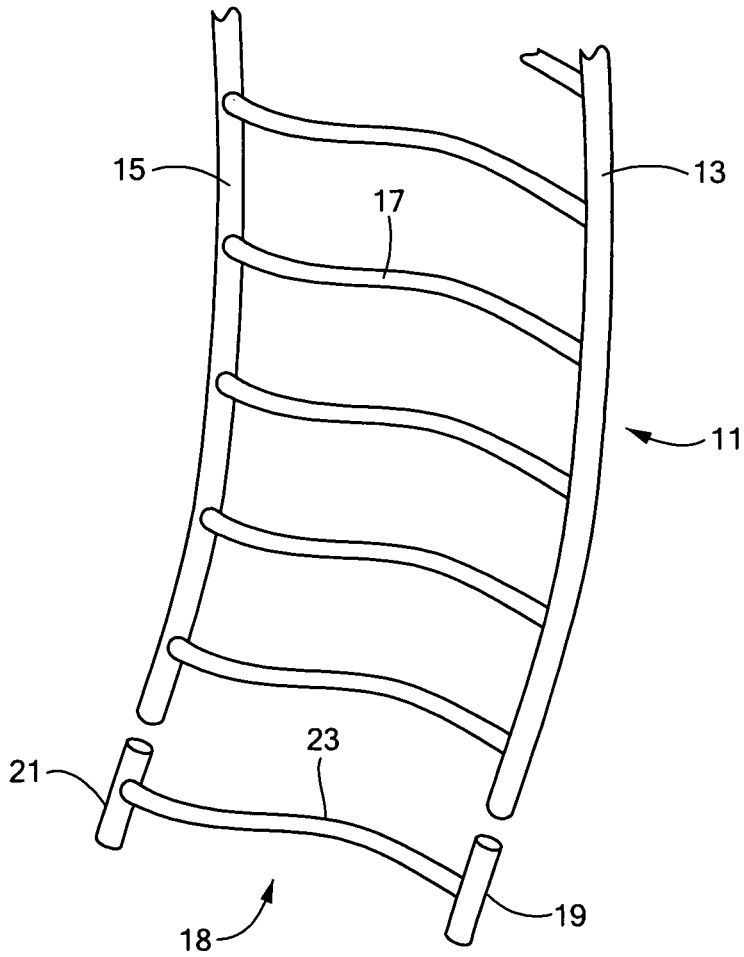
FIG. 2 is an enlarged, fragmentary, front perspective view of a length of the continuously connected fastener stock shown in FIG. 1.

Referring now to FIG. 2, there is shown a length of continuously connected ladder stock which may used in connection with device 10, the ladder stock being identified generally by reference numeral 11. Ladder stock 11 is preferably made of plastic and comprises a pair of elongated and continuous side members, or rails, 13 and 15 which are interconnected by a plurality of equidistantly spaced cross-links 17.

An individual plastic fastener 18 is obtained from ladder stock 11 by severing side members 13 and 15 at the approximate midpoint between successive cross-links 17. Fastener 18 comprises a pair of cross-bars 19 and 21 which are interconnected by a thin, flexible filament 23, cross-bars 19 and 21 comprising sections of side members 13 and 15, respectively, and filament 23 comprising a cross-link 17.

It should be noted that the pitch for ladder stock 11 is commonly defined as the distance between successive cuts in each of side members 13 and 15 which is required to create plastic fastener 18 (i.e., the length of each of cross-bars 19 and 21). In the same manner, it is to be understood the pitch for ladder stock 11 can be determined by measuring the distance between successive cross-links 17.

It should be noted that, by severing side members 13 and 15 at the approximate midpoint between successive cross-links 17, fastener 18 is provided with an H-shaped configuration, wherein opposing ends of filament 23 bisect corresponding cross-bars 19 and 21. As can be appreciated, it is typically preferred that fastener 18 have an H-type configuration when used in its conventional application of coupling together two or more items.

Construction of Fastener Dispensing Device 10

As seen most clearly in FIGS. 1 and 3-5, device 10 comprises a substantially rectangular base 31 which serves as the support, or foundation, for device 10. Base 31 may be provided with means to facilitate securing device 10 to a workstation or other similar platform, such as circular bores 32 formed at particular locations along its periphery through which screws can be driven.

A block-shaped neck 33 is integrally formed onto the top surface of base 31. An enlarged, rectangular frame 34 is formed on top of neck 33. As will become apparent below, frame 34 serves as the support, or floor, on which various mechanical and electrical components for device 10 are mounted.

An elongated support arm 35 extends out from both base 31 and neck 33 in an forward and upward manner, support arm 35 being spaced substantially away from the underside of frame 34. A reactor plate 37 is mounted on the free end of support arm 35 and functions, among other things, to support the articles to be coupled by one or more fasteners 18 using device 10.

A protective housing 39 extends upwardly from the free end of frame 34 and includes left and right side casings 40-1 and 40-2 that are secured together by screws. Housing 39 is preferably constructed of a rigid, durable and impact-resistant material, such as plastic, and serves to protect the majority of the electrical and mechanical components for device 10 that are mounted on frame 34.

As can be seen, a substantial arcuate recess 41 is formed in the top surface of housing 39. Furthermore, a cylindrical reel holder 46 is mounted on right side casing 40-2 and extends transversely through recess 41. Holder 46 is sized and shaped to axially pass through a longitudinal bore formed in a reel 42 of ladder stock 11 that is positioned within recess 41. Accordingly, holder 46 serves to support reel 42 in such a manner that reel 42 is capable of freely rotating (i.e., spinning) thereon, thereby affording device 10 with the capability to continuously dispense plastic fasteners 18 in an automated fashion. As will be described in greater detail below, the majority of reel 42 is preferably retained within recess 41, thereby rendering the combination of reel 42 and device 10 relatively streamlined and compact in nature, which is highly desirable.

A door 43 encloses the front end of housing 39 and is pivotally connected to right side casing 40-2 by hinges 44 to provide access to the head assembly for device 10. A narrow slot 45 is defined between door 43 and housing 39 through which a supply of ladder stock 11 may be fed. Preferably, the dimensions of slot 45 are minimally greater than the lateral cross-section of ladder stock 11 so as to limit the extent by which undesirable contaminants (e.g., dust) can enter into the interior cavity defined by housing 39.

A user interface 47 is provided in the front of pivotally mounted door 43 and preferably includes a digital display panel 49 (e.g., an LCD screen) and one or more control buttons 51-1 through 51-4. As will be described further in detail below, user interface 47 provides an operator with means to both monitor relevant historical data relating to usage of device 10 and regulate certain operational characteristics of device 10, which is highly desirable.

Figure 6:
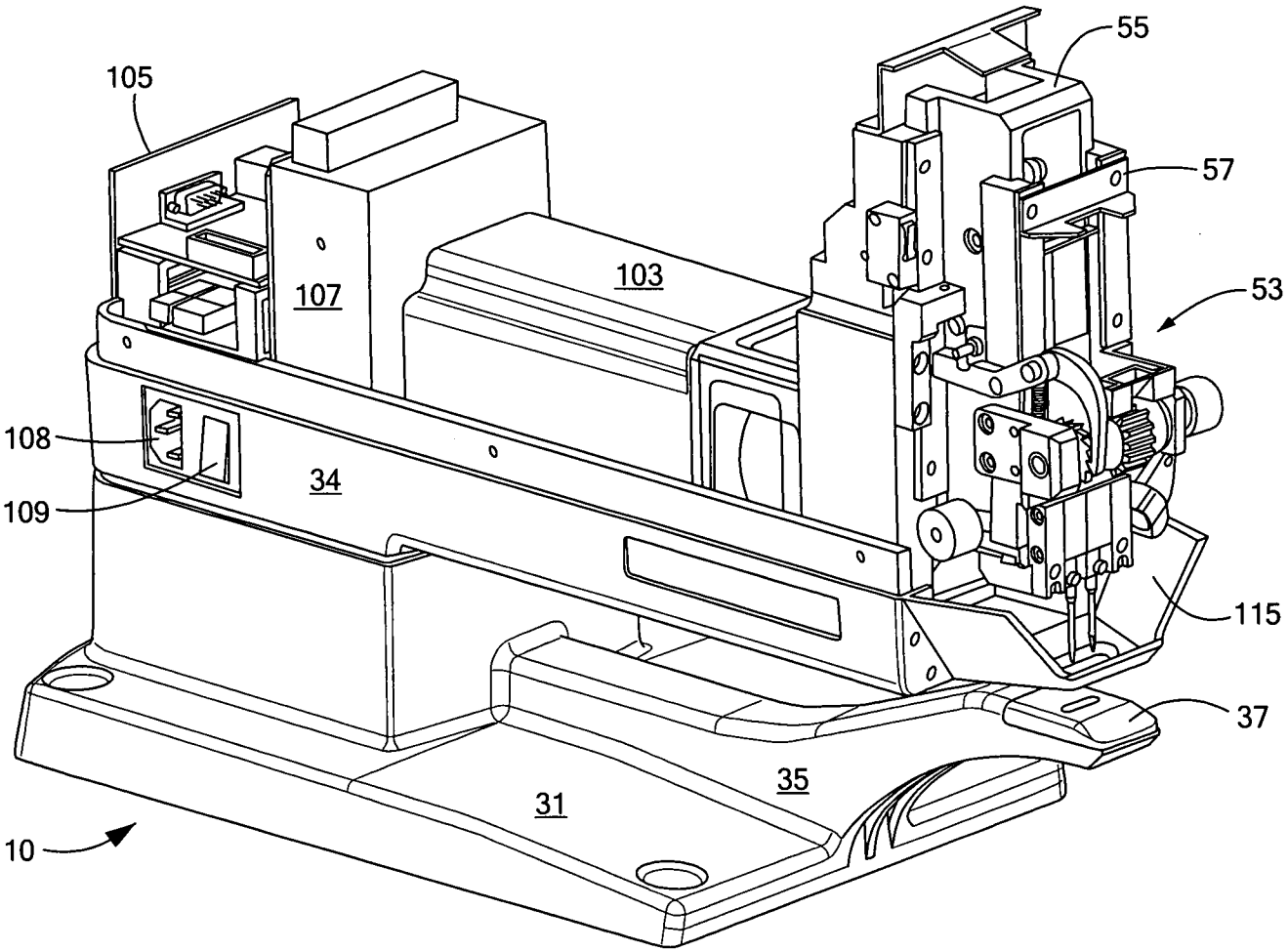
FIG. 6 is a left side perspective view of the fastener dispensing device shown in FIG. 1, the fastener dispensing device being shown with its housing and door removed therefrom for purposes of simplicity and clarity.
Figure 7:
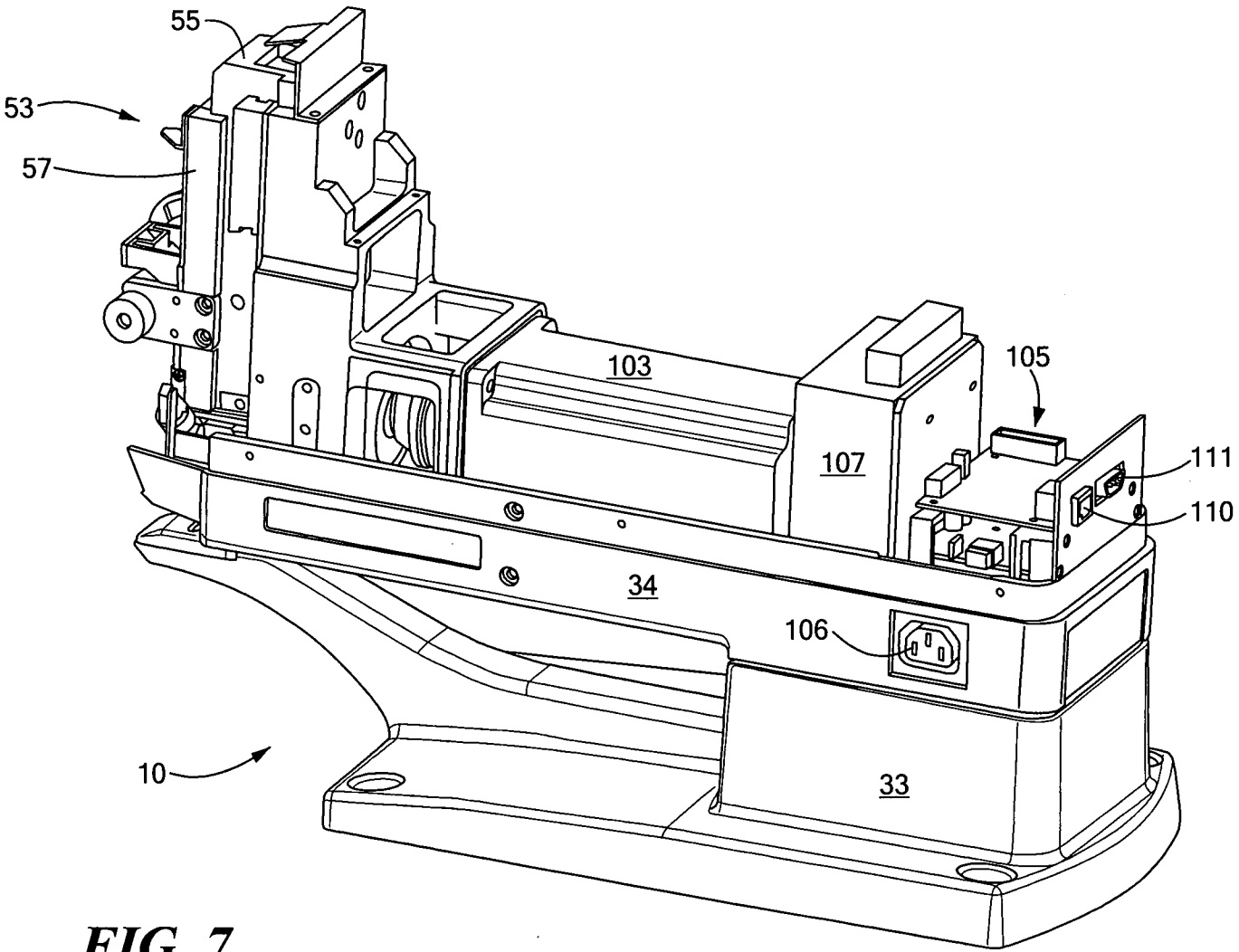
FIG. 7 is a right side perspective view of the fastener dispensing device shown in FIG. 1, the fastener dispensing device being shown with its housing and door removed therefrom for purposes of simplicity and clarity.
Figure 8:
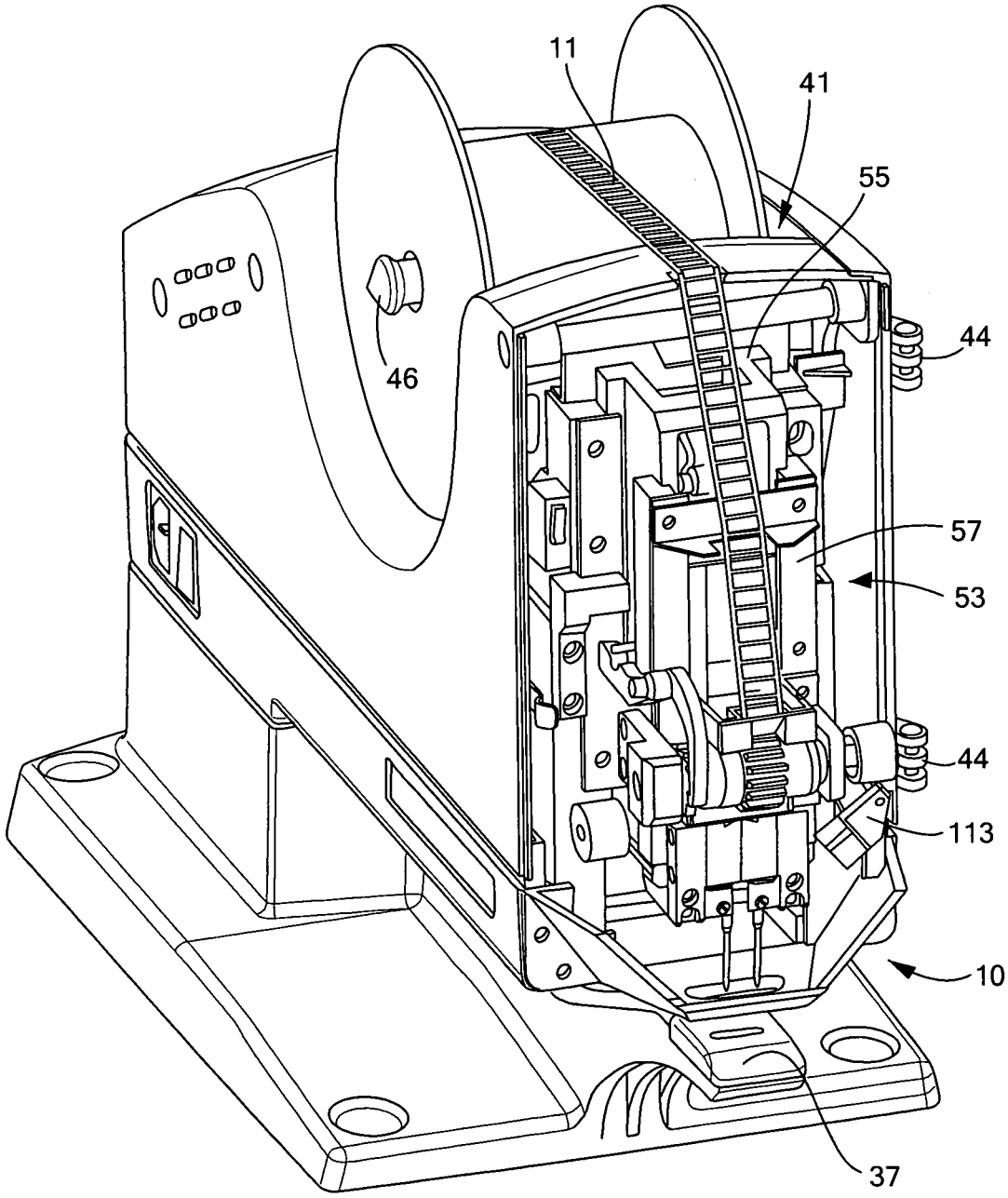
FIG. 8 is a front perspective view of the fastener dispensing device and the reel of continuously connected fastener stock shown in FIG. 1, the fastener dispensing device being shown with its door removed therefrom for purposes of simplicity and clarity.

As seen most clearly in FIGS. 6-8, device 10 includes a head assembly 53 mounted on frame 34 behind door 43 that is responsible for, among other things, feeding the supply of ladder stock 11 into device 10, severing an individual fastener 18 from ladder stock 11 and, in turn, ejecting the severed fastener 18 through the desired articles. It should be noted that head assembly 53 can be easily accessed by the operator by pivoting door 43 open.

Head assembly 53 comprises a vertically extending mount 55 that is fixedly retained in place on frame 34, mount 55 being generally U-shaped in lateral cross-section. A motor-driven, vertically displaceable head 57 is slidably coupled to mount 55, the function of head 57 to become apparent below.

Figure 9:
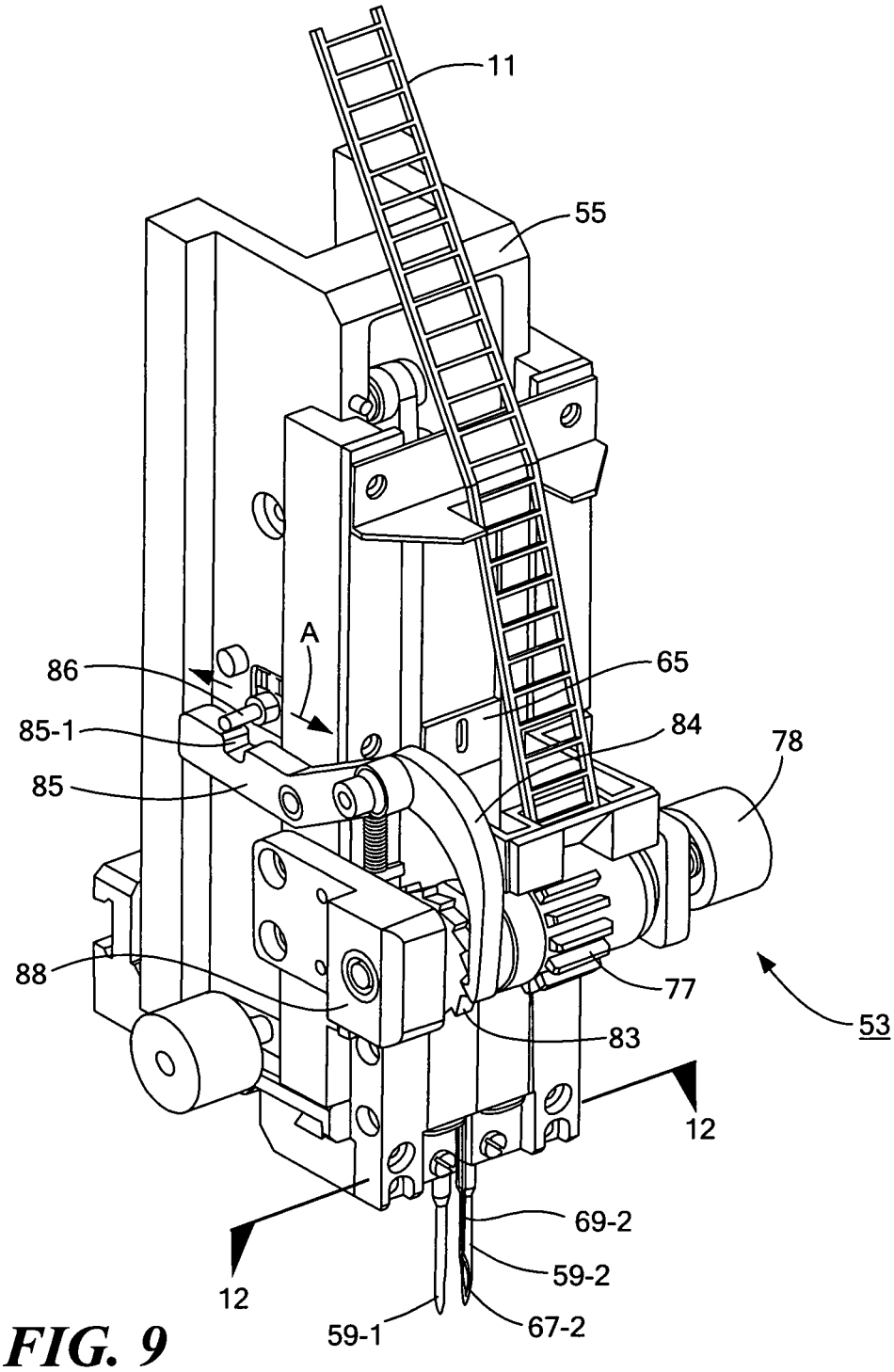
FIG. 9 is a left side perspective view of the head assembly for the fastener dispensing device shown in FIG. 1, the head assembly being shown with a length of fastener stock partially fed thereinto.
Figure 10:
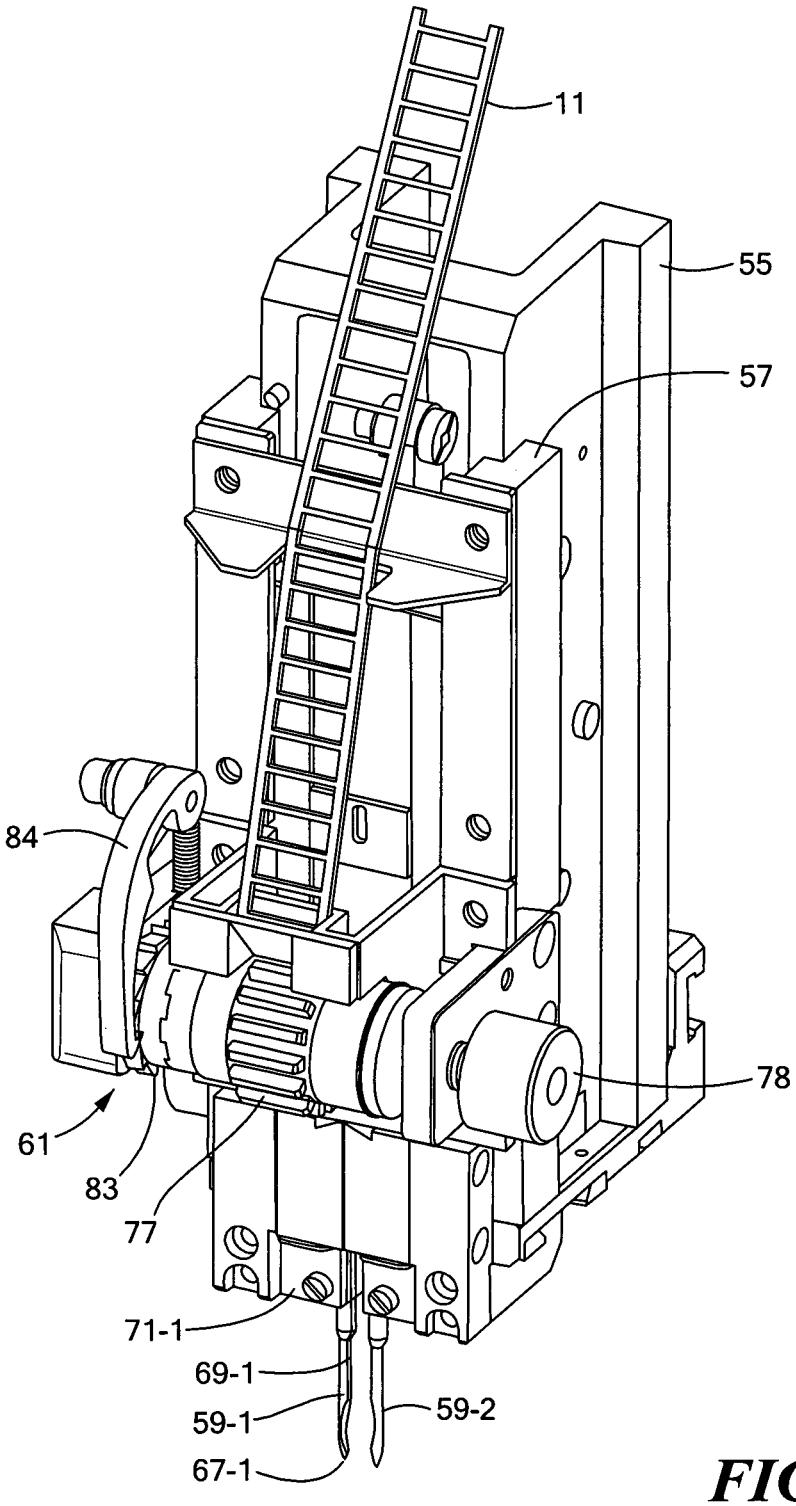
FIG. 10 is a right side perspective view of the head assembly for the fastener dispensing device shown in FIG. 1, the head assembly being shown with a length of fastener stock partially fed thereinto.
Figure 11:
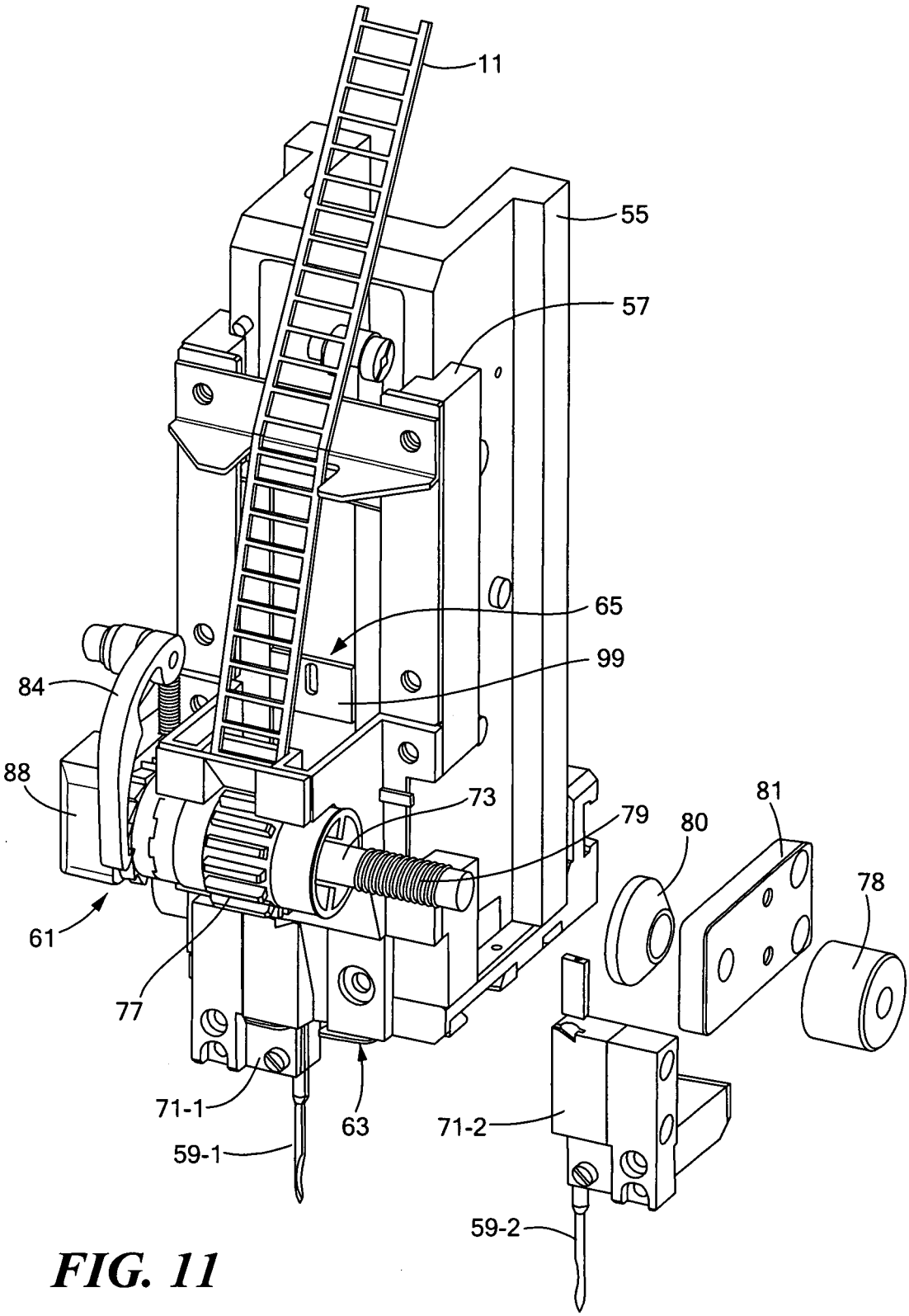
FIG. 11 is a partially exploded, right side perspective view of the head assembly for the fastener dispensing device shown in FIG. 1, the head assembly being shown with a length of fastener stock partially fed thereinto.

As seen most clearly in FIGS. 9-11, head assembly 53 additionally includes a pair of hollowed needles 59-1 and 59-2 which are adapted to penetrate through the articles to be coupled together by plastic fastener 18, a feed mechanism 61 for advancing the side members 13 and 15 of ladder stock 11 into axial alignment behind the longitudinal bores defined by needles 59, a severing mechanism 63 for cutting side members 13 and 15 of ladder stock 11 at the approximate midpoint between successive cross-links 17 to separate an individual plastic fastener 18 from the remainder of ladder stock 11, and an ejection mechanism 65 for ejecting cross-bars 19 and 21 of severed plastic fastener 18 through needles 59-1 and 59-2 and in turn through the items to be coupled together by fastener 18.

Each needle 59 is conventional in its construction and includes an elongated longitudinal bore 67 and a narrow longitudinal slot 69 in communication with bore 67. Needles 59 are coupled to motor-driven head 57. Accordingly, it is to be understood that the downward displacement of head 57 in turn causes needles 59 to similarly travel downward so as to penetrate through any articles supported on reactor plate 37.

It should be noted that needles 59-1 and 59-2 are removably mounted onto corresponding needle holders 71-1 and 71-2, respectively. As seen most clearly in FIG. 11, needle holder 71-1 is held fixed in place whereas needle holder 71-2 is slidably mounted along a laterally disposed axle 73 which is capable of rotation about its longitudinal axis. Accordingly, the ability to slide needle holder 71-2 laterally relative to needle holder 71-1 allows for the spacing between needles 59 to be adjusted to accommodate ladder stocks 11 with cross-links 17 of varying lengths (e.g., between 0.25 inches and 0.38 inches), which is highly desirable. As seen most clearly in FIG. 5, once the desired spacing between needles 59 has been set, a screw (not shown) may be used to hold needle holder 71-2 fixed in place along axle 73.

Figure 12:
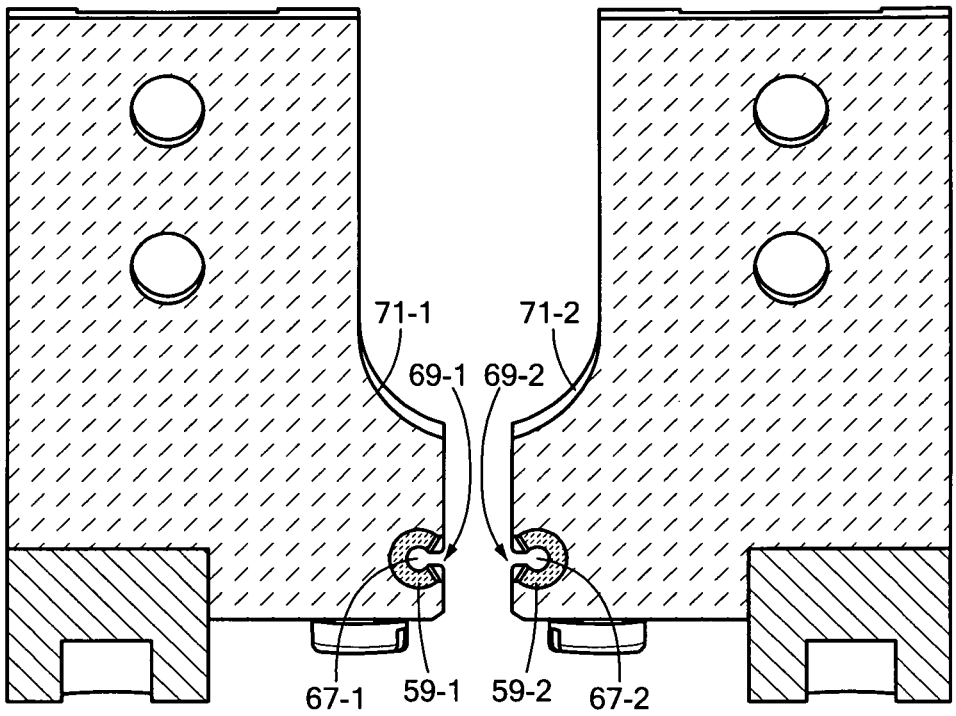
FIG. 12 is an enlarged, section view of the pair of needles and the pair of needle holders shown in FIG. 9, the view being taken along lines 12-12.

As seen most clearly in FIG. 12, needles 59-1 and 59-2 are preferably mounted within needle holders 71-1 and 71-2 such that slots 69-1 and 69-2 directly oppose one another (i.e., slots 69 are disposed in-line with one another). In this manner, as a fastener 18 is ejected through needles 59, filament 23 can be held taut therebetween. As a result, filament 23 stretches during the ejection process, thereby increasing the strength by which fastener 18 secures together two or more intended articles, as will be described further in detail below.

As briefly noted above, feed mechanism 61 is responsible for continuously advancing the free end of ladder stock 11 into alignment behind needles 59 for subsequent ejection therethrough. As seen most clearly in FIG. 11, feed mechanism 61 includes a feed wheel 77 that is fixedly mounted onto axle 73. In operation, feed wheel 77 is adapted to engage the cross-links 17 of ladder stock 11. As a result, the rotation of feed wheel 77 serves to advance (i.e., feed) the supply of ladder stock 11 into device 10. Preferably, a feed knob 78 is coupled to one end of axle 73 by a spring 79, with an end cap 80 and a mounting bracket 81 mounted on axle 73 between feed knob 78 and spring 79. As can be appreciated, feed knob 78 allows for three manual feed operations: (1) the rotation of feed knob 78 in the clockwise direction in order to advance ladder stock 11 into its stop (i.e., loading) position within device 10 prior to the severing and ejection processes; (2) the inward displacement of feed knob 78 coupled, at the same time, with the rotation of feed knob 78 in the counterclockwise direction in order to back out, or withdraw, a supply of ladder stock 11 from device 10; and (3) the inward displacement of feed knob 78 coupled, at the same time, with the small, incremental rotation of feed knob 78 in either the clockwise or counterclockwise direction in order to fine tune feed mechanism 61 (i.e., to fine tune the stop position in which feed mechanism 61 loads the next successive fastener 18 in ladder stock 11 prior to the severing and ejection processes).

As seen most clearly in FIG. 9, a feed ratchet 83 is fixedly mounted on axle 73 and is thereby indirectly connected to feed wheel 77 (i.e., rotation of feed ratchet 83 results in the rotation of feed wheel 77). A feed pawl 84 is disposed to selectively engage and rotate feed ratchet 83 as part of the process of indexing fastener stock 11 through device 10. Specifically, feed pawl 84 is pivotally connected at one end to a spring-biased feed lever 85 which regulates movement of feed pawl 84, feed lever 85 being pivotally connected to movable head 57.

A mechanical switch 86 in the form of a pin is mounted on mount 55 and is capable of being laterally displaced (as represented by arrows A in FIG. 9) between either of two fixed positions. With switch 86 disposed in its first position (hereinafter referred to as its single-shot position), switch 86 is disposed to align within a notch 85-1 formed in feed lever 85 which in turn causes feed pawl 84 to advance a single cross link 17 of fastener stock 11 behind needles 59 prior to ejection (i.e., by causing feed pawl 84 to engage the next successive tooth on feed ratchet 83 during successive strokes of device 10). To the contrary, with switch 86 disposed in its second position (hereinafter referred to as its double-shot position), switch 86 is disposed to align outside of notch 85-1 formed in feed lever 85 which in turn causes feed pawl 84 to advance a pair of cross links 17 of fastener stock 11 behind needles 59 prior to ejection (i.e., by causing feed pawl 84 to skip ahead in such a manner so as to engage every second tooth on feed ratchet 83 during successive strokes of device 10).

In operation, the completion of a single stroke cycle for head assembly 53 causes a feed pawl 84 to rotate feed ratchet 83 in the clockwise direction, the degree of rotation being dependent upon the particular setting of switch 86. The rotation of feed ratchet 83 serves to similarly rotate feed wheel 77 in the clockwise direction which, in turn, advances ladder stock 11 in the forward direction into device 10. In the same manner, it is to be understood that rotation of feed ratchet 83 in the counterclockwise direction would serve to rotate feed wheel 77 in the opposite direction (i.e., such that ladder stock 11 is withdrawn, or backed out, from device 10). However, it has been found that, during the automated feeding process for device 10, any slight rearward withdrawal of ladder stock 11 can cause ladder stock 11 to become jammed within device 10, which is highly undesirable. Accordingly, feed mechanism 61 is provided with a one-way mechanical clutch 88 that is responsible for, among other things, precluding feed ratchet 83 from inadvertently rotating in the counterclockwise direction in such a manner so as to cause ladder stock 11 to jam within device 10.

As noted briefly above, a severing mechanism 63 is responsible for severing the lowermost fastener 18 from the loaded fastener stock 11 after the fastener stock has been advanced to its stop position by feed mechanism 61. As seen most clearly in FIG. 13, severing mechanism 63 comprises a single sharpened knife blade 89 that is positioned directly behind the rear end of needles 59-1 and 59-2, respectively. Specifically, flattened knife blade 89 is disposed within a track formed in the underside of a base 90 for head assembly 53 (i.e., directly above its corresponding needle holder 71) and is held flush thereagainst by a spring assembly 91.

Spring assembly 91 includes a mechanical cutting lever 92 which is coupled to head 57 and which extends down through a corresponding hole formed in knife blade 89, an enlarged stop 93 formed on the free end of lever 92 and a spring 95 axially mounted on lever 91. In this manner, it should be noted that spring 95 serves to continuously urge knife blade 89 upward within the track formed in the underside of base 90.

In operation, once head 57 reaches a particular location during its downward stroke, knife lever 92 slides knife blade 89 forward within the track in base 90 (as represented by arrow B). The forward displacement of knife blade 89 ultimately causes its sharpened cutting edge 97 to slice through side rails 13 and 15 of ladder stock 11, thereby separating a single fastener 18 therefrom. Upon completion of the severing process, lever 92 rearwardly displaces knife blade 89 back to its original position.

It is to be understood that spring 95 serves to hold knife blade 89 firmly against the underside of base 90 but without compromising the ability of knife blade 89 to travel in either the forward or rearward direction during the severing process. As a result, the inclusion of spring assembly 91 serves to ensure that the location of cutting edge 97 behind needles 59 stays fixed, thereby improving the accuracy and reliability of the process by which rails 13 and 15 are cut. In this manner, each fastener 18 severed from ladder stock 11 consistently has an H-shaped configuration, which is highly desirable.

As noted briefly above, ejection mechanism 65 is responsible for dispensing the cross-bars 19 and 21 of a severed fastener 18 out through needles 59 and, in turn, through the desired items to be coupled together. Ejection mechanism 65 preferably includes a motor-driven slide plate 99, which is adapted to slide vertically relative to head 57, and first and second ejector rods (not shown) that are fixedly coupled to slide plate 99. As can be appreciated, the pair of ejector rods extend down from slide plate 99 in alignment with longitudinal bores 67-1 and 67-2, respectively.

Referring back to FIGS. 6 and 7, device 10 comprises a stepper motor 103 for powering the stroke cycle for head assembly 53. Stepper motor 103 (also referred to herein as step motor 103 or stepping motor 103) is located inside housing 39 and is used to power head assembly 53 through the fastener dispensing process. Stepper motor 103 is defined herein as being a clutch-free, direct current (DC) motor that translates electrical pulses into precise, discrete steps. For example, step motor 103 may regulate output movement to as low as 1/200 of a revolution. In this manner, it is to be understood that step motor 103 is capable of producing a relatively high degree of control in response to a particular input signal.

A programmable electronic controller 105 is located within the interior cavity defined by housing 39 and is electrically connected to stepper motor 103. Controller 105 preferably includes a main printed circuit board and an application-specific integrated circuit (ASIC) microprocessor. As will be described in detail below, controller 105 is responsible for, among other things, compiling historical data relating to the use of device 10 and adjusting certain characteristics relating to the operation of head assembly 53 (e.g., stroke speed, cycle type, etc.), as will be described further in detail below.

It should be noted that controller 105 is electrically connected to user interface 47. In this manner, an operator is able regulate certain characteristics relating to the operation of device 10 using control buttons 51, as can be seen most clearly in FIG. 3.

As an example, controller 105 is able to regulate the duration of time that power is applied to step motor 103 upon activation. In this manner, it is to be understood that an operator can regulate the number of strokes executed by device 10 for each actuation cycle, this feature being referred to herein as the stroke mode for device 10. As defined herein, the term actuation cycle relates to the entire period of time during which an actuation mechanism for device 10 (e.g., a pedal or trigger) is activated (e.g., the period of time when an actuation pedal is depressed without being released).

Figure 3:
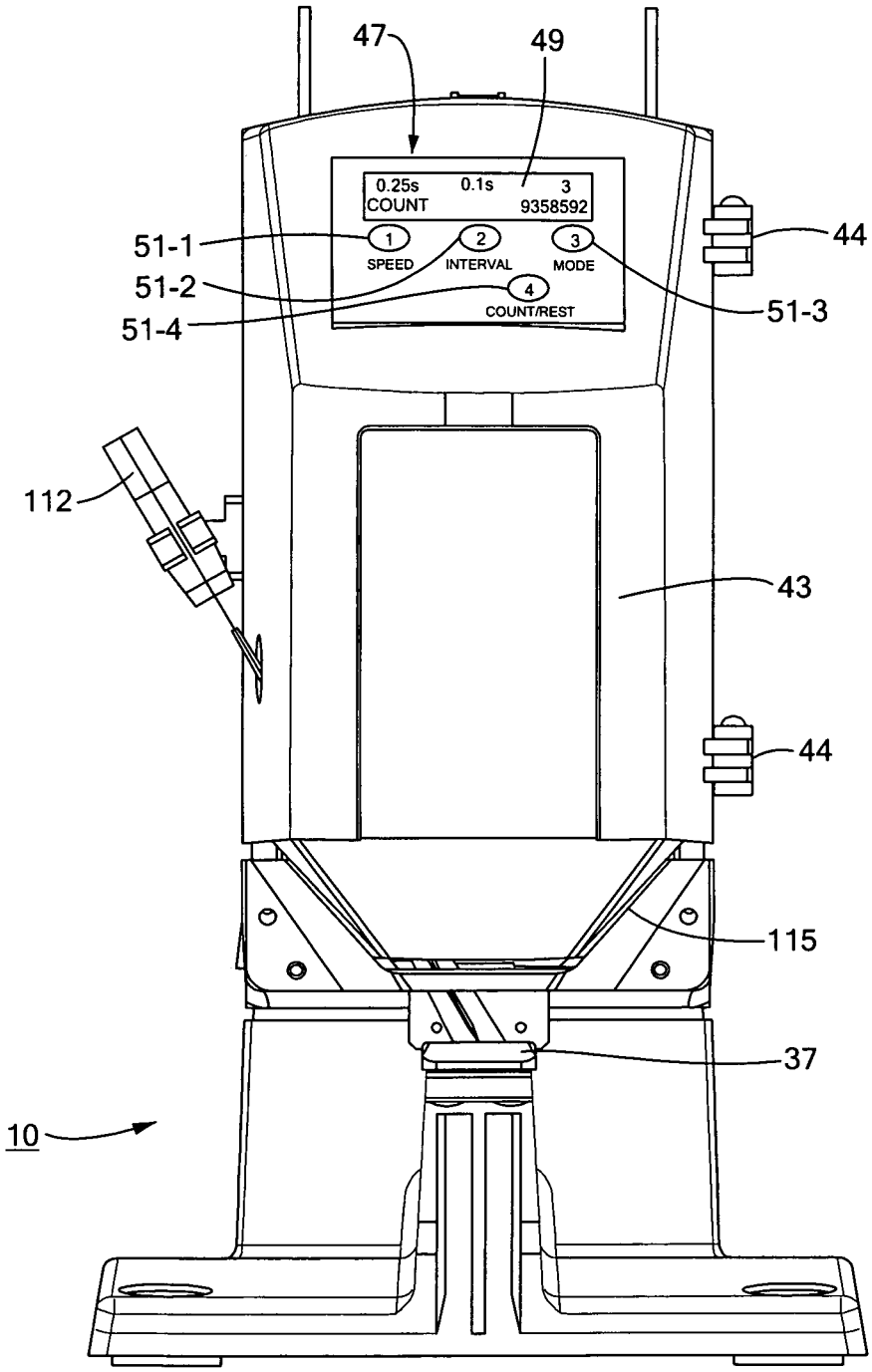
FIG. 3 is a front plan view of the fastener dispensing device and the reel of continuously connected fastener stock shown in FIG. 1.

More specifically, through repeated depression of control button 51-3, the operator can regulate whether device 10 operates under either a single stroke mode, a multiple stroke mode (e.g., 2-10 strokes for each actuation cycle) or a continuous stroke mode setting, the particular stoke mode selected by the user being preferably provided on display 49 for the benefit of the operator (e.g., a 3 stroke mode setting is shown on display 49 on FIG. 3).

It is to be understood that with device 10 configured in its single stroke mode setting, activation of device 10 (e.g., by stepping on an actuation pedal that is connected to pedal port 106) causes controller 105 to supply head assembly 53 with only enough power from step motor 103 to complete a single stroke (i.e., to dispense only one single-shot or double-shot fastener from fastener stock 11). In order to dispense a second fastener with device 10 configured in its single stroke mode setting, the user is required to then activate device 10 a second time (e.g., by releasing the actuation pedal and stepping on the pedal a second time). The activation process is then repeated as deemed necessary to dispense the requisite number of fasteners. As can be appreciated, traditional fastener dispensing devices are designed to operate using only a single stroke mode.

However, as can be appreciated, certain applications require the dispensing of a large quantity of fasteners in rapid succession. Accordingly, by using interface 47 to configure device 10 to operate using either multiple stroke cycle or a continuous stroke cycle, power can be supplied to step motor 71 in such a manner so that a plurality of fasteners is dispensed from device 10 through a single actuation process (e.g., by maintaining the actuation pedal in a depressed condition), which is highly desirable.

As another example, controller 105 is designed to regulate the stroke speed for device 10. Specifically, through repeated depression of control button 51-1, an operator can modify the stroke speed for device 10, the intended range of stroke speeds preferably being 0.10 seconds to 1.00 seconds with 0.05 second intervals between successive settings. The stroke speed setting for device 10 is preferably provided on display 49 for the benefit of the operator (e.g., a 0.25 second stroke speed is shown on display 49 in FIG. 3).

Preferably, the actuation stroke for device 10 is relatively constant in speed (i.e., includes no significant levels of acceleration or deceleration). However, it is to be understood that one could modify stroke speed for device 10 by adjusting a portion of the operation cycle without departing from the spirit of the present invention. For instance, the stroke speed could be modified by accelerating or decelerating one or more of the following: (i) the rate of the downward travel for head 57 (i.e., the speed in which needles 59 are penetrated through the intended articles), (ii) the rate of the fastener ejection process (i.e., the speed in which a fastener 18 is passed through the intended articles), and/or (iii) the rate of the upward travel for head 57 (i.e., the speed in which needles 59 retract from the intended articles).

As another example, controller 105 is designed to allow for the inclusion of a controllable delay between successive strokes when device 10 is configured in either its multiple stroke mode or its continuous stroke mode setting. Specifically, through repeated depression of control button 51-2, an operator can modify delay between successive strokes, the intended range of stroke speeds preferably being 0.1 seconds to 1.0 seconds with 0.1 second intervals between successive settings. The delay is preferably provided on display 49 for the benefit of the operator (e.g., a 0.1 second delay is shown on display 49 in FIG. 3). As a result, an operator will have adequate time to manipulate the articles to be fastened together by fasteners 18 between successive cycle strokes.

As another example, controller 105 is designed to count the number of strokes undertaken by device 10 during a particular period of time which, in turn, can be used to count the number of fasteners 18 dispensed. The historical data collected is then preferably provided on display 49 for the benefit of the operator (e.g., the count 935592 is shown on display 49 in FIG. 3). Additionally, it is to be understood that the counter reading on display 49 can be both (i) toggled between multiple counters (e.g., a batch counter and a life counter) and (ii) reset using control button 51-4.

It is also to be understood that one or more control buttons 51 could be used to provide additional operational features without departing from the spirit of the present invention. For example, device 10 could be designed to require the input of a particular password prior to operation, the password being input using control buttons 51.

As seen most clearly in FIGS. 6 and 7, a direct current (DC) power switching supply 107 is electrically connected to stepper motor 103 and is responsible for, among other things, regulating the supply of power that is input to stepper motor 103 from an alternating current (AC) power source (e.g., a standard electrical outlet) via AC connector 108 on frame 34. A power switch 109 is similarly provided to provide manual means for regulating the operational state of device 10.

Figure 4:
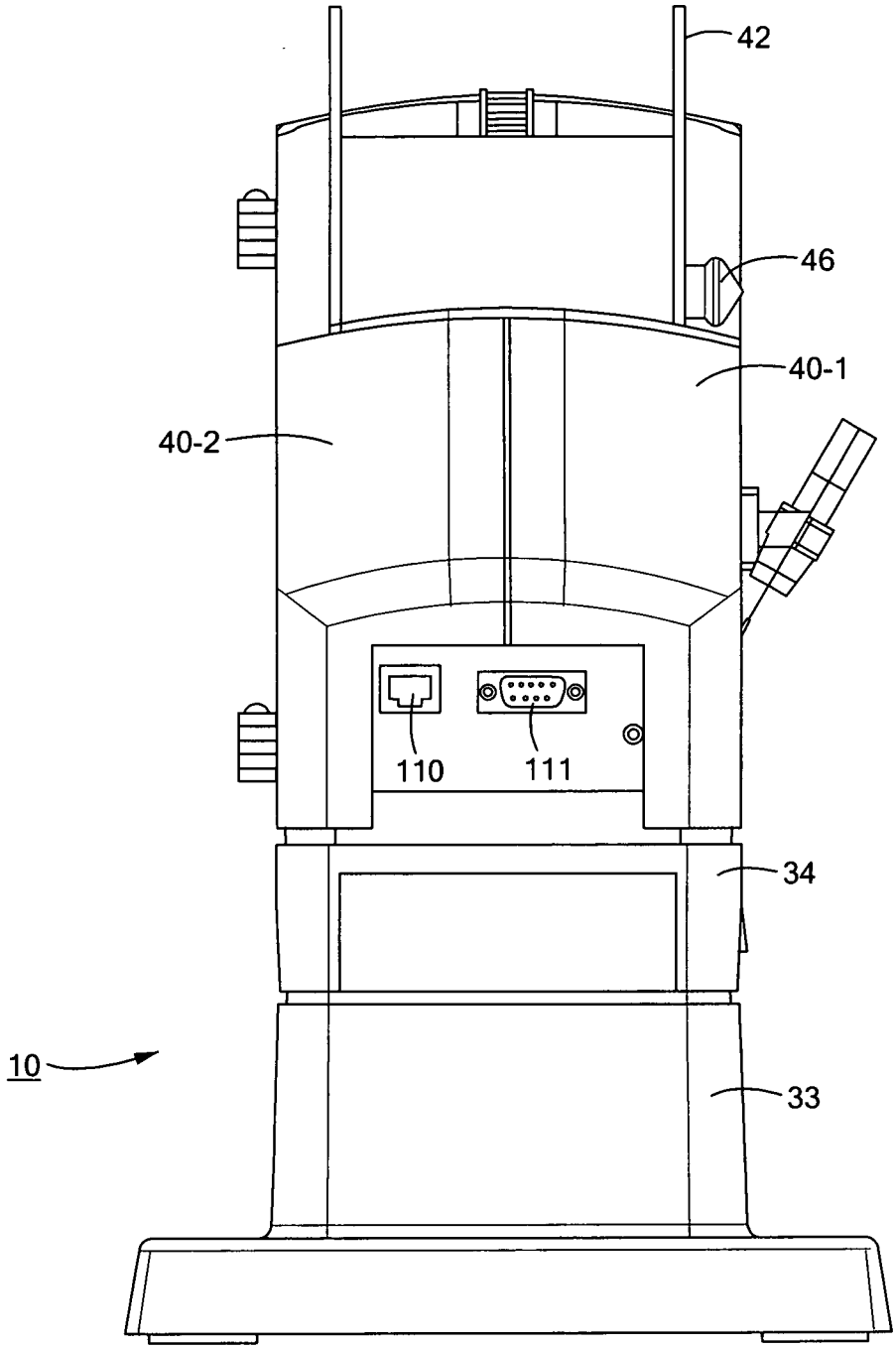
FIG. 4 is a rear plan view of the fastener dispensing device and the reel of continuously connected fastener stock shown in FIG. 1.

As seen most clearly in FIGS. 4 and 7, an ethernet data port 110 is electrically connected to controller 105 and is mounted on frame 34 in an externally accessible manner. As will be described further below, data port 110 enables pertinent information relating to the operation of device 10 (e.g., historical data collected) to be transferred from controller 105 to a computer linked thereto through a communication network (e.g., the internet). In addition, a serial connector 111 is electrically connected to controller 105 to provide alternative means of transferring data from controller 105 to a compute device (e.g., during initial configuration of device 10).

As seen most clearly in FIGS. 1 and 3, device 10 additionally includes an optical guidance device 112 which is fixedly mounted on left side casing 40-1. Device 112 is preferably in the form of a light emitting diode (LED) or laser which is orientated to provide a highly focused, pinpoint spot on reactor plate 37 directly beneath the tip of needle 59-1. In this manner, device 112 provides the operator with a visual means of aligning where needle 59-1 will penetrate an item disposed on reactor plate 37 during operation.

As seen most clearly in FIG. 8, device 10 further includes a fixedly mounted illumination device 113, such as a lamp. Illumination device 113 is provided to light up reactor plate 37 to assist an operator working in a dimly light environment.

It should also be noted that head assembly 53 is specifically calibrated to dispense individual fasteners 18 from ladder stock 11 which has a pitch of 0.1875 inches. To the contrary, traditional fastener dispensing machines are calibrated to dispense individual fasteners from ladder stock which has a pitch of 0.25 inches. As can be appreciated, significant benefits are derived from calibrating device 10 to dispense plastic fasteners from ladder stock having a 0.1875 inch pitch and, as such, will be described in detail below.

It should further be noted that device 10 is designed to allow for greater clearance around reactor plate 37, thereby rendering it easier for an operator to move larger, more bulky articles (e.g., clothing) along reactor plate 37.

For instance, as seen most clearly in FIG. 6, a guard, or shield, 115 is fixedly mounted onto the front of frame 34, guard 115 being provided with a small opening through which needles 59 protrude during the needle penetration portion of the actuation cycle. In use, guard 115 serves to protect the user from inadvertently contacting the sharpened tips of needles 59. As can be seen, guard 115 is specifically designed with a generally U-shaped configuration (i.e., a central plate with two side members extending at an approximate right angle relative thereto) so as to minimize its interference with an article being placed upon or removed from reactor plate 37.

Figure 5:
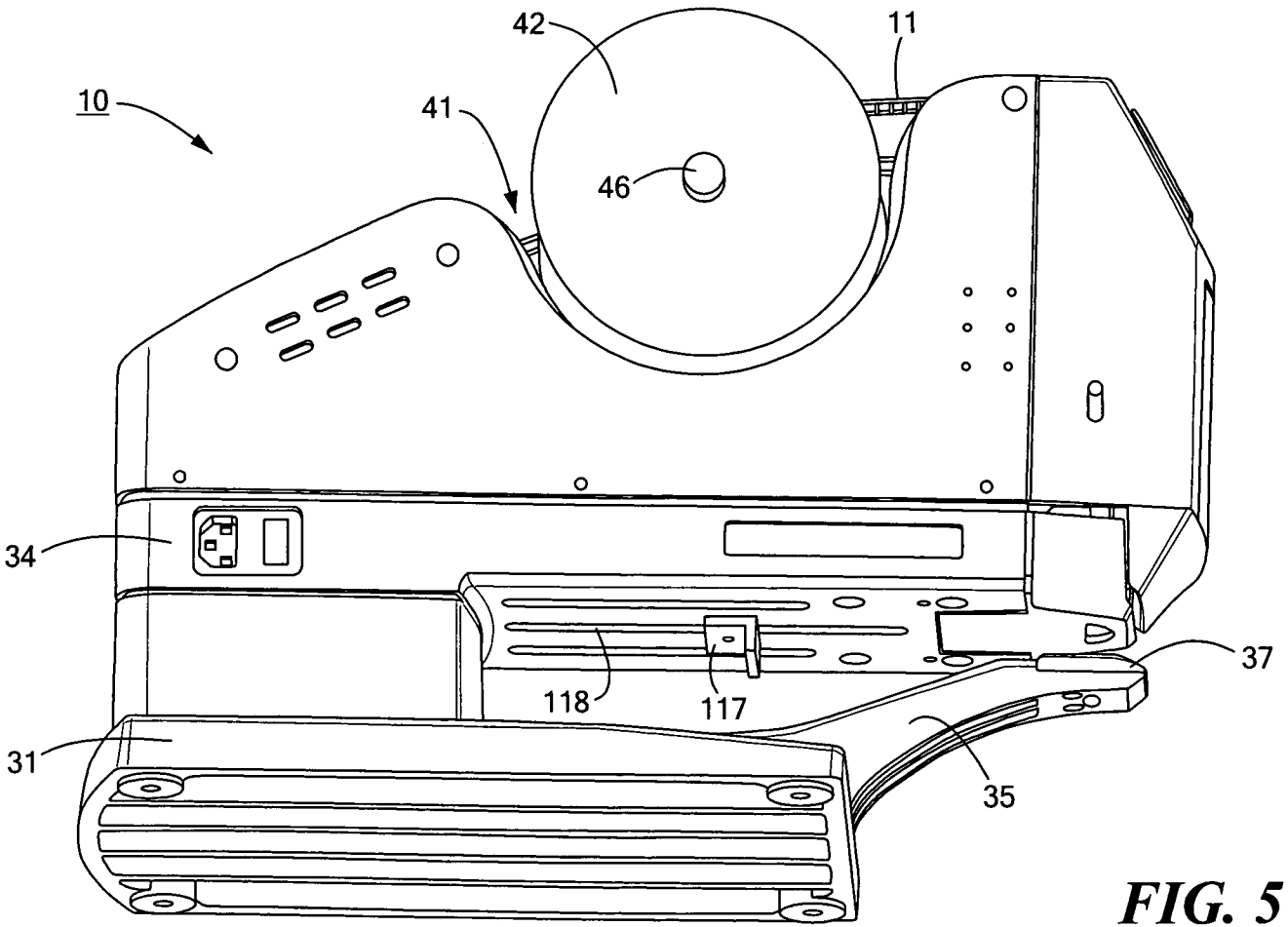
FIG. 5 is a bottom perspective view of the fastener dispensing device and the reel of continuously connected fastener stock shown in FIG. 1.

Furthermore, the spacing between frame 34 and support arm 35 is maximized so as to facilitate the movement of larger articles along reactor plate 37. Referring now to FIG. 5, a downwardly extending backstop 117 is mounted on the underside of frame 34. Preferably, backstop 117 can be displaced along a linear groove 118 formed in the underside of frame 34 (i.e., towards or away from reactor plate 37). When disposed in its desired position, a spring screw (not shown) can be used to retain backstop 117 fixed in place on frame 34. In this manner, it is to be understood that backstop 117 serves to limit the degree by which articles can be slid rearwardly along reactor plate 37, which is highly desirable in certain applications.

Performance Advantages Achieved by Fastening Dispensing Device 10

The notable design features for device 10 set forth in detail above introduce a number of significant performance advantages, which are listed below.

(1) Calibration of Device 10 for 0.1875 Inch Ladder Stock—As noted above, device 10 is specifically calibrated to dispense individual fasteners 18 from a supply of ladder stock 11 which has a pitch of 0.1875 inches, the pitch of ladder stock 11 being defined as the distance, or spacing, between successive filaments 17. It has been found that the use of 3/16 inch pitch fastener stock 11 with fastener dispensing device 10 introduces a few notable advantages over the use of fastener stock having a greater pitch (e.g., ¼ inch).

As a first advantage, the reduced pitch allows for a greater number of fasteners 18 to be wound onto each fastener spool 42. Specifically, ladder stock with a ¼ inch pitch can retain approximately 25,000 fasteners per reel whereas ladder stock with 3/16 inch pitch can retain approximately 40,000 fasteners per reel. The substantial increase in the number of fasteners per reel afforded by reducing the fastener pitch minimizes the frequency of spool replacements. Because fastener spool reloading is a relatively time-consuming process, any reduction in the number of fastener spool replacements increases productivity, which is highly desirable.

As a second advantage, the reduced pitch reduces the amount of plastic required to manufacture fastener stock 11, thereby reducing waste, which is highly desirable.

As a third advantage, the reduced pitch reduces the stroke length of the actuation cycle for the fastener dispensing machine. As a result, reduced pitch fasteners can be dispensed at a considerably faster rate which, in turn, increases productivity, which is highly desirable.

(2) Stroke Mode Adjustability—As noted above, an operator can configure device 10 via user interface 47 to operate using either (i) a single stroke mode, (ii) a multiple stroke mode, or (iii) a continuous stroke mode for each depression of its actuation pedal. As can be appreciated, it has been found that a single stroke mode would be preferred in certain applications which require a single fastener 18 to be dispensed (e.g., in an article pairing application), a multiple stroke mode would be preferred in certain applications which require a few fasteners 18 to be dispensed in rapid succession (e.g., a heavy duty article pairing application), and a continuous stroke mode would be preferred in certain applications which require a continuous stream of fasteners 18 to be dispensed in rapid succession (e.g., whiskering applications in the jeans industry). In this manner, it is to be understood that device 10 can be adjusted to suit the particular needs of the consumer, which is highly desirable.

(3) Stroke Speed Regulation—Fastener dispensing machines which are well-known in the art typically operate at a fixed stroke speed (approximately 0.50 seconds/stroke). However, it has been found that the stroke speed of traditional machines is often inadequate in particular applications.

Accordingly, controller 105 is programmed to allow an operator to adjust the speed of stepper motor 103 via user interface 47 which in turn enables the speed of the stroke for head assembly 53 to be correspondingly adjusted. In particular, device 10 is designed to allow the speed of the stroke for head assembly 53 to be regulated between 0.10 seconds/stroke and 1.00 seconds/stroke. In this manner, the stroke speed can be adjusted based on the intended application.

For example, a slow stroke rate (e.g., 1.00 seconds/strokes) is often preferred when device 10 is used to dispense plastic fasteners 18 through a thicker material (i.e., a heavy-duty application) in order to prevent each fastener 18 from breaking during ejection.

As another example, a fast stroke rate (e.g., 0.10 seconds/stroke) is often preferred when device 10 is used to dispense plastic fasteners 18 through a thinner material in order to maximize productivity (i.e., the number of fasteners dispensed per hour).

(4) Increased Power Efficiency—Traditional fastener dispensing machines utilize an induction motor which requires a continuous supply of AC power. In use, actuation of the device electrically activates a switching device (e.g., a solenoid) which, in turn, mechanically disengages a motor clutch. With the clutch disengaged, the induction motor cycles which in turn causes the device to dispense a fastener. As can be appreciated, it has been found that the continuous application of AC power to an induction motor renders this type of fastener dispensing machine highly inefficient from a power consumption standpoint, which is highly undesirable.

Accordingly, it should be noted that device 10 utilizes a stepper motor which, by definition, does not require a continuous supply of power. Rather, in use, power is only supplied to stepper motor 103 when device 10 is actuated. Upon actuation (e.g., by depressing the actuation pedal), controller 105 ensures that the necessary supply of power is applied to stepper motor 103 to complete the designated actuation cycle for head assembly 53 (i.e., such that device 10 fires one or more fasteners 18). Otherwise, when idle, the only power consumed by device 10 is by its cooling fans (not shown). As a result, device 10 is considerably more energy efficient than traditional fastener dispensing machines, which is highly desirable.

(5) Variable Input Power Capability—Traditional fastener dispensing machines utilize an induction motor that is designed to be powered by an electrical outlet of a particular voltage (e.g., 110 volts, 220 volts, etc.). As a result, traditional machines are only designed for use in selected countries, thereby limiting potential usage, which is highly undesirable.

To the contrary, it should be noted that switching power supply 107 provides device 10 with the capability to be powered by a wide range of different voltage outlets (notably, in the range between 90 volts and 250 volts). Specifically, switching power supply 107 is designed to convert the input AC voltage supplied to device 10 from any electrical outlet to the requisite DC voltage level required by stepper motor 71. As a result, device 10 can be used in a broader range of markets, which is highly desirable.

(6) System Monitoring Capabilities—Traditional fastener dispensing machines operate as stand-alone units. To the contrary, device 10 is provided with an ethernet data port 110 which is connected to controller 105. Data port 110 is designed for connection to a communication network (e.g., the internet) and, as such, provides device 10 with the capability to support a unique internet protocol (IP) address. In this manner, device 10 is rendered remotely accessible through the communication network, which is highly desirable.

As can be appreciated, pertinent data collected by controller 103 (e.g., historical fastener dispensing information stored in the counter) can be accessed by a remote compute device. As a result, a centralized monitoring station can be provided to track, monitor and/or analyze pertinent historical data relating to one or more devices 10 (e.g., the number of fasteners dispensed during a particular time period). This information can be used, among other things, to improve the productivity and/or efficiency of device 10 (e.g., by making cycle speed adjustments to a particular device 10 from the centralized monitoring station), which is highly desirable.

(7) Increased Retentive Strength of Dispensed Fastener—Traditional fastener dispensing machines include a pair of spaced apart needles, each needle having a longitudinal slot that is orientated at an acute angle away from the opposing needle). As a result, with the cross-bars 19 and 21 of a fastener 18 disposed through the pair of needles, the thin filament 23 tends to arc, or bow, in a generally C-shaped configuration.

To the contrary, device 10 includes needles 59 with slots 69 disposed in-line with one another (i.e., directly facing one another), as seen most clearly in FIG. 8. With ladder stock 11 fed into device 10, the spacing between needles 59 can be adjusted (i.e., increased) such that the filament 23 for the lowermost fastener 18 is held taut. Accordingly, as the lowermost fastener 18 is ejected through needles 59, filament 23 tends to stretch, thereby increasing the retentive force exerted by fastener 18 on the articles being secured together thereby, which is highly desirable.

(8) Improved Accuracy of Fastener Severing Process—Traditional fastener dispensing machines include a pair of flattened knife blades, each knife blade being sandwiched between a pair of fixed block-shaped members. In order to ensure that each knife blade will move properly during the severing process, traditional machines often space the pair of block-shaped members apart from one another with added clearance. As can be appreciated, this added clearance causes the knife blades to move vertically between the members which, in turn, has been found to compromise the ability of traditional machines to consistently and accurately cut rails 13 and 15 of ladder stock 11 at the exact midpoint between successive cross-links 17.

Figure 13:
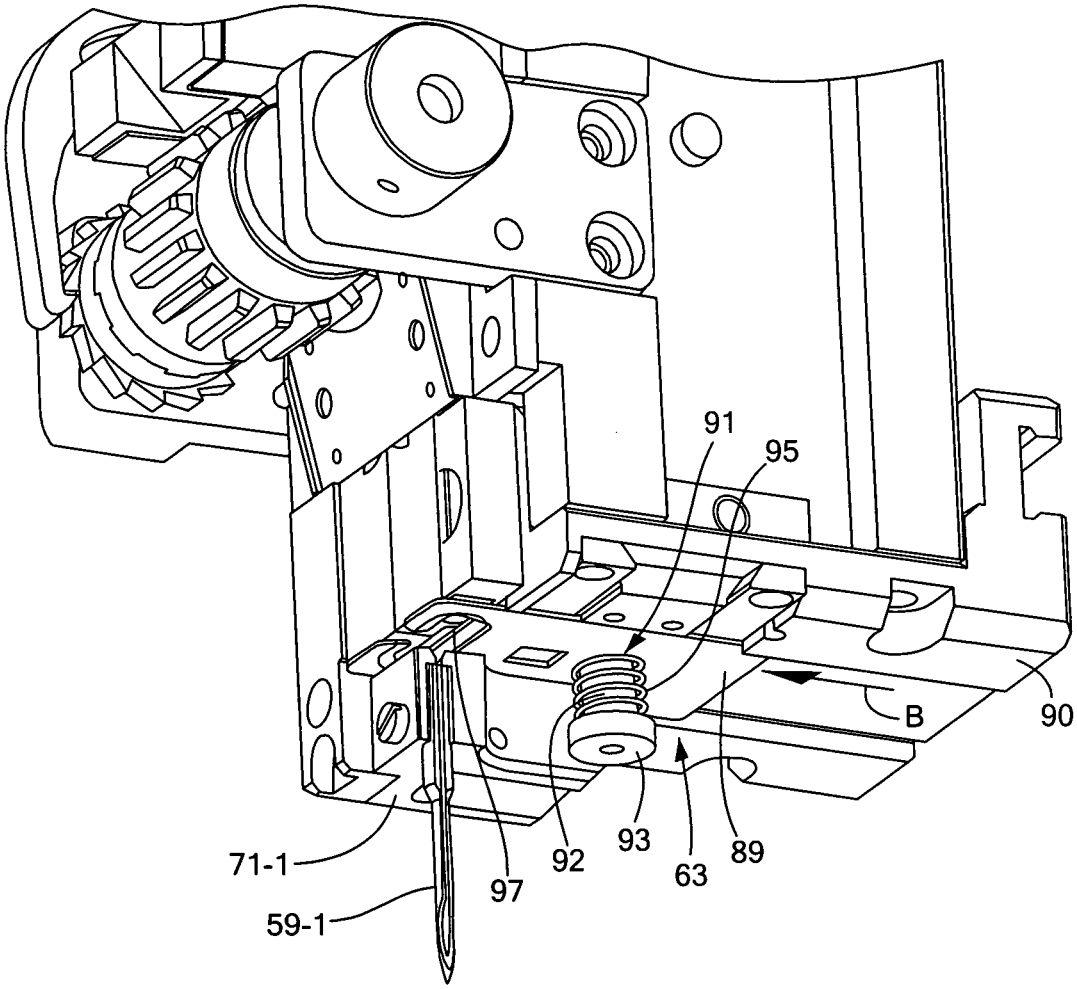
FIG. 13 is an enlarged, bottom perspective view of the head assembly shown in FIG. 9, the head assembly being shown with its right needle holder removed therefrom for purposes of simplicity and clarity.

To the contrary, the inclusion of spring assembly 91 in device 10 serves to retain knife blade 89 firmly against the underside of base 90 (as seen in FIG. 13) but without impeding knife blade 89 from being able to slide during the severing process. As a result, device 10 is designed to more reliably and consistently cut rails 13 and 15 of ladder stock at the exact midpoint between successive cross-links 17, which is highly desirable.

(9) More Compact and Streamlined Design—As noted above, housing 39 of device 10 includes a semi-circular recess 41 that is sized and shaped to support and receive at least a portion of a reel 42 of ladder stock 11. In this manner, a reel 42 of ladder stock 11 can be effectively integrated into the overall design of device 10. As a result, device 10 is provided with a more streamlined and compact design than conventional fastener dispensing machines, thereby rendering device 10 highly desirable in environments with limited workspace (e.g., assembly lines).

It should also be noted that semi-circular recess 41 is preferably approximately 6.5 inches in diameter and, as such, is sized and shaped to receive reels 42 of fastener stock 11 that are less than 6.5 inches in diameter. In this manner, device 10 is effectively designed to receive only selected types of manufactured ladder stock 11 (i.e., compatible reels 42 distributed by the manufacturer of device 10).

(10) Environmentally Sealed Housing—As noted above, slot 45, through which ladder stock 11 is fed into head assembly 53, is only slightly larger in lateral cross-section than the lateral cross-section of fastener stock 11. As a result, the degree by which harmful particles, such as dust, dirt and the like, can enter into the interior cavity of the device 10 is minimized, which is highly desirable.

(11) Greater Clearance around Reactor Plate—As noted above, device 10 includes a number of design modifications (e.g., a narrower needle guard 115) which together increase the amount of clearance, or spacing, around reactor plate 37. As a result, an operator can more easily manipulate larger articles (e.g., jeans) along reactor plate 37 prior to the fastener dispensing process, which is highly desirable.

(12) Ability to Incorporate an Adjustable Delay into Dispensing Process—As noted above, controller 105 is preferably programmed to allow for an adjustable delay to be introduced between successive strokes when device 10 is configured in either its multiple stroke mode or its continuous stroke mode setting. As a result, an operator who is dispensing a large quantity of fasteners in a rapid-fire manner is afforded a brief delay (approximately 0.1-1.0 seconds) prior to the ejection of each successive fastener 18 to reposition the article on reactor plate 37, which is highly desirable.

Figure 14:
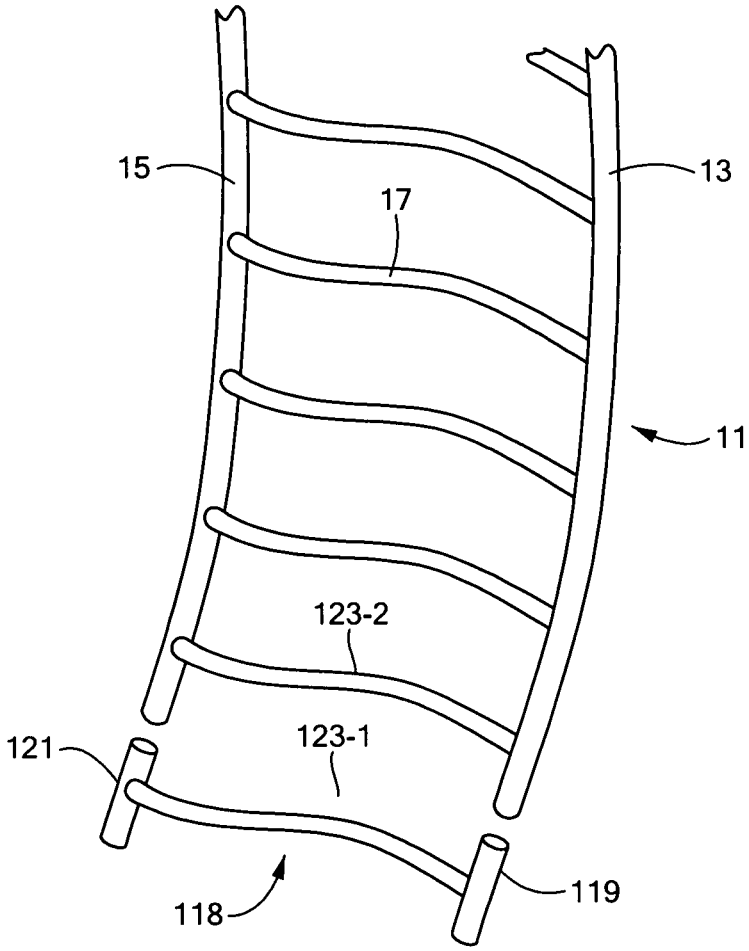
FIG. 14 is an enlarged, fragmentary, front perspective view of the supply of continuously connected fastener stock shown in FIG. 2, the supply of fastener stock being shown with a double fastener severed therefrom.

(13) Ability to Dispense a Double Fastener from Ladder Stock—Switch 86 can be configured so that device 10 dispenses a double fastener (also referred to herein as a double-shot fastener) from ladder stock 11. Specifically, referring now to FIG. 14, there is shown supply of ladder stock 11 which includes rails 13 and 15 which are interconnected by a plurality of equidistantly spaced cross-links 17, the pitch between successive cross-links being approximately 0.1875 inches.

As described in detail above, disposing switch 86 in its double-shot position causes feed pawl 84 to engage every second tooth on feed ratchet 83 during successive strokes of device 10. As a result, for each stroke of device 10, a pair of cross-links 17 is indexed behind needles 59 prior to the severing process. In this manner, device 10 serves to sever rails 13 and 15 at the approximate midpoint between every other cross-link 17 so as to yield a plurality of double-shot fasteners 118.

A double-shot fastener 118 obtained from ladder stock 11 includes a pair of parallel cross-bars 119 and 121, each of cross bars 119 and 121 being approximately 0.22 inches in length (i.e., two times the length of cross-bars 19 and 21). Cross-bars 119 and 121 are interconnected by a pair of thin, flexible, transverse filaments 123-1 and 123-2 which are disposed in parallel relative to one another and spaced apart approximately 0.1875 inches.

Figure 15A:
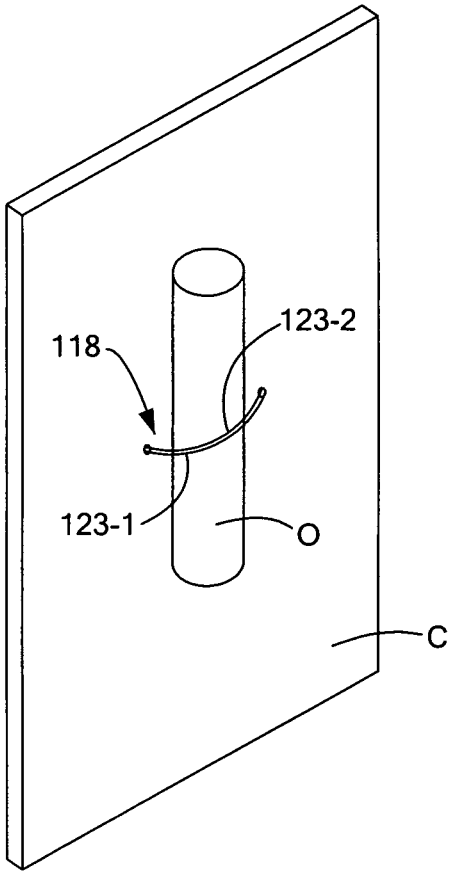
FIGS. 15(*a*) and (*b*) are front and rear perspective views, respectively, of an article being secured to a display card using the double fastener shown in FIG. 14.
Figure 15B:
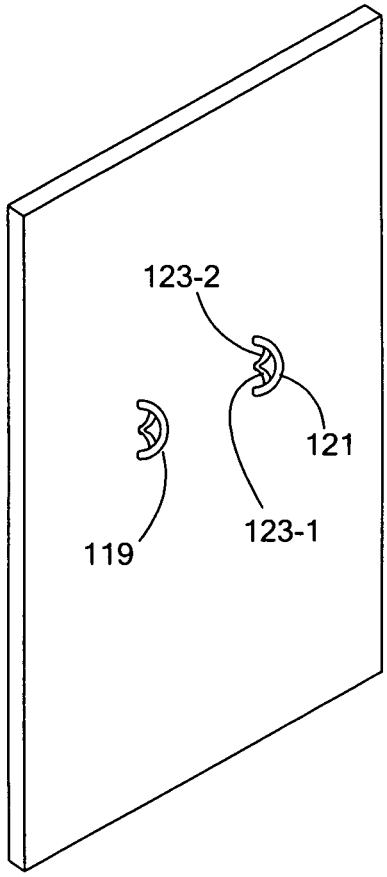

Referring now to FIGS. 15(*a*) and 15(*b*), there are shown front and rear perspective views, respectively, of a double-shot fastener 118 being used to secure a cylindrical object O against a display card C.

As seen most clearly in FIG. 15(*a*), object O is held against display card C by pair of filaments 123-1 and 123-2 (rather than a single filament as in traditional fastener dispensing applications). Accordingly, it is to be understood that the use of a pair of filaments 123 serves to significantly increase the retentive force imparted by fastener 118 in securing object O to display card C, which is highly desirable.

As seen most clearly in FIG. 15(*b*), due to the dual filament 123 design of fastener 118, each of cross-bars 119 and 121 tends to bend when dispensed through display card C. Specifically, each of cross-bars 119 and 121 adopts a curved, horseshoe-like shape against the rear surface of display card C which renders fastener 118 less susceptible to the two following methods of fastener tampering which are commonly experienced in conjunction with traditional H-type fasteners (e.g., fastener 18).

In the first tampering method, unscrupulous consumers often separate items coupled together with an H-type fastener 18 by pulling on an end of filament 23 with such force that either of straightened cross-bars 19 and 21 buckles into a Y-shaped configuration (this tampering process often being referred to simply as "Y-ing" in the art). Once buckled in this manner, the damaged cross-bar can be pulled back through the hole in article through which it originally passed, thereby enabling the articles to be separated, which is highly undesirable.

As can be appreciated, the dual filament design of fastener 118 renders it unsusceptible to this type of tampering. Specifically, because each of cross-bars 119 and 121 already has a curved, horseshoe-shape when dispensed through an article, it can not be buckled into a Y-shaped configuration by pulling on filaments 123.

In the second tampering method, unscrupulous consumers often separate items coupled together with an H-type fastener 18 by first twisting (i.e., pivoting) either of straightened cross-bars 19 and 21 into a substantially parallel relationship relative to filament 23 and then axially inserting the twisted cross-bar back through the hole in the article through which it originally passed, thereby enabling the articles to be separated, which is highly undesirable.

As can be appreciated, the dual filament design of fastener 118 renders it unsusceptible to this type of tampering. Specifically, because each of cross-bars 119 and 121 has a curved, horseshoe shape when dispensed through an article, it can not be axially inserted back through a hole in the article.

Figure 16:
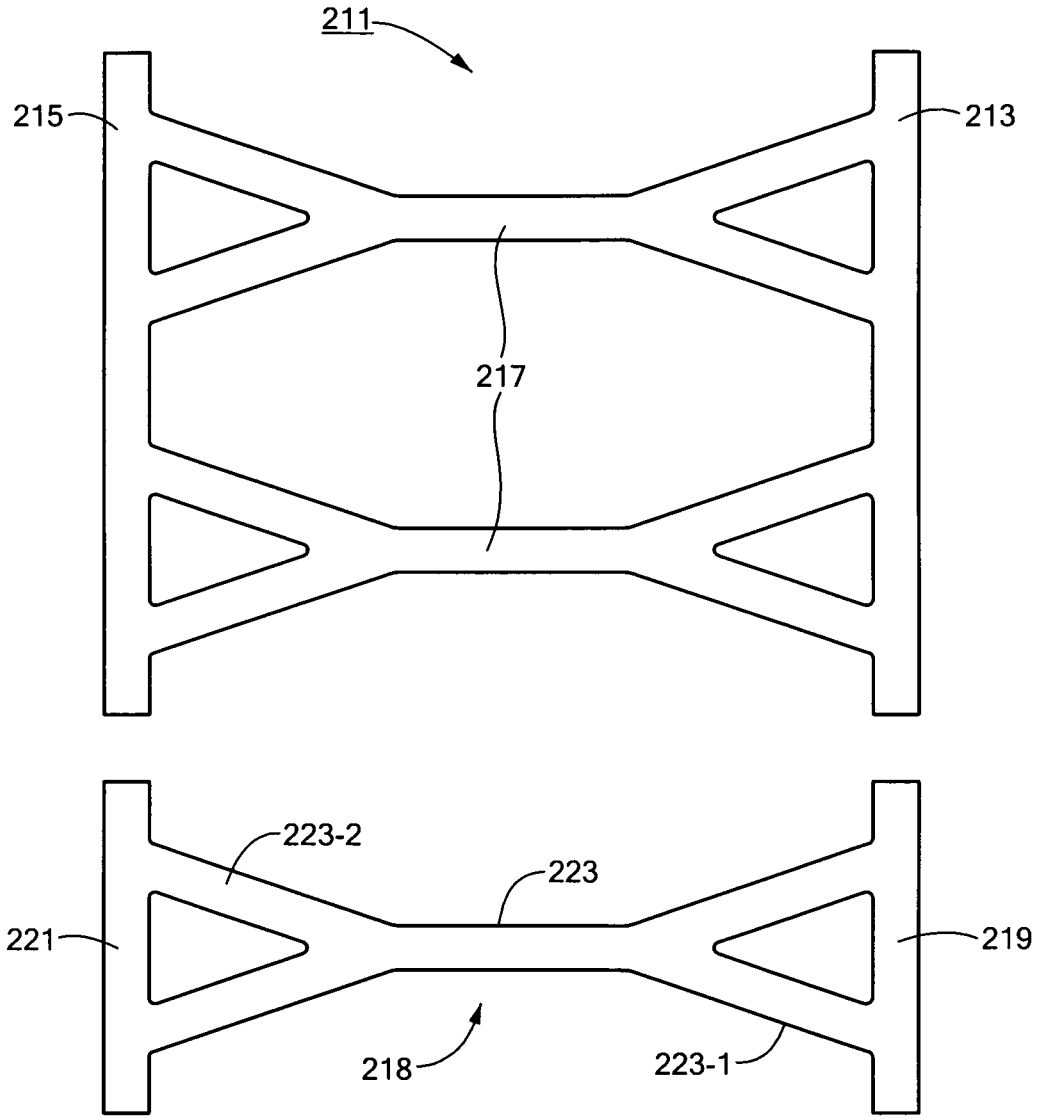
FIG. 16 is an enlarged, fragmentary, top plan view of a length of continuously connected fastener stock which has been constructed according to the teachings of the present invention.

Referring now to FIG. 16, there is shown a supply of fastener stock which is constructed according to the teachings of the present invention, the fastener stock being identified generally by reference numeral 211. As will be described further below, a fastener separated from fastener stock 211 has similar retentive characteristics as double-shot fastener 118 and, as such, is less susceptible to the two aforementioned types of fastener tampering.

Specifically, fastener stock 211 is preferably made of plastic through a continuous molding process and comprises a pair of elongated and continuous side members, or rails, 213 and 215 which are interconnected by a plurality of equidistantly spaced cross-links 217, the spacing between the midpoint of successive cross-links preferably being approximately 0.1875 inches. As part of its fastener dispensing process, device 10 preferably severs rails 213 and 215 at the approximate midpoint between successive cross-links 217 so as to yield individual fasteners 218.

Figure 17:
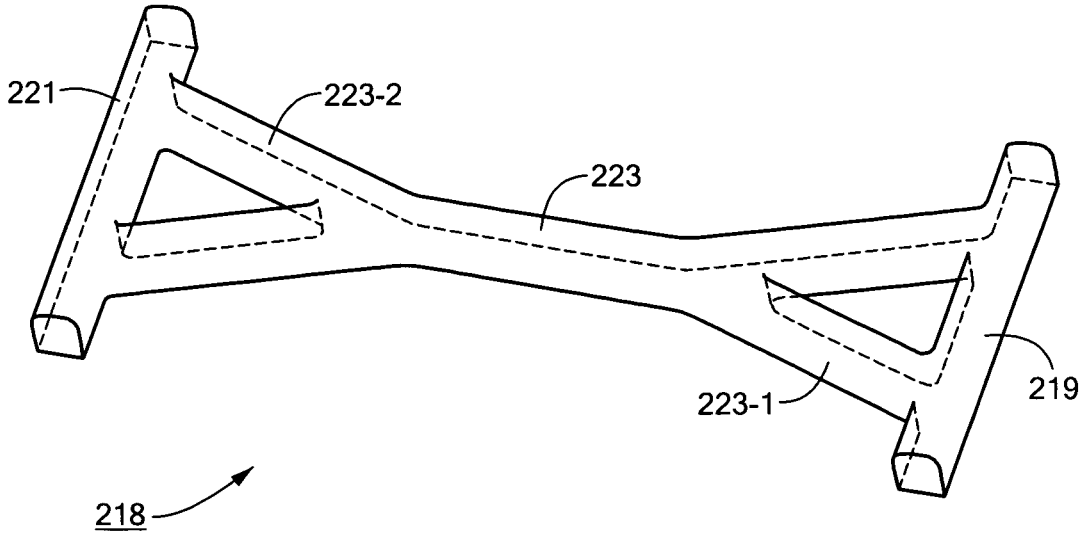
FIG. 17 is a top perspective view of a fastener severed from the length of continuously connected fastener stock shown in FIG. 16.

As seen most clearly in FIG. 17, each fastener 218 obtained from fastener 211 includes a pair of parallel cross-bars 219 and 221, each of cross bars 219 and 221 being approximately 0.11 inches in length. However, it is to be understood that fastener stock 211 could be constructed so as to yield fasteners 218 with cross bars 219 and 221 of alternate lengths without departing from the spirit of the present invention.

Cross-bars 219 and 221 are interconnected by a thin, flexible filament 223 which extends transversely therebetween, filament 223 having a first end 223-1 which is formed onto cross bar 219 and a second end 223-2 which is formed onto cross bar 221. As can be seen, first end 223-1 branches into a generally V-shaped configuration and connects to cross bar 219 at two separate points of contact. Similarly, second end 223-2 branches into a generally V-shaped configuration and connects to cross bar 221 at two separate points of contact.

As can be appreciated, because each end of filament 223 is formed onto its corresponding cross-barthrough two separate points of contact, fastener 218 experiences similar anti-tampering qualities as double-shot fastener 118 and, as a consequence, is highly desirable. Specifically, due to its bifurcated design, each of first and second ends 223-1 and 223-2 bends into a horseshoe-style shape when dispensed through an article, thereby rendering each end less susceptible to fastener tampering by means of the methods described in detail above.

It should be noted that fastener 218 is not limited to having a two-prong (i.e., bifurcated) design at first and second ends 223-1 and 223-2. Rather, it is to be understood that each of first and second ends 223-1 and 223-2 could branch into more than two points of contact with its corresponding cross bar (i.e., a three-prong design) without departing from the spirit of the present invention.

It should also be noted that fastener 218 is not limited to a branched design at both ends of filament 223. Rather, it is to be understood that filament 223 may be limited to a branched design at only one of its ends without departing from the spirit of the present invention.

The embodiments shown in the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A device for dispensing an individual plastic fastener from a supply of fastener stock, the fastener stock being shaped to include a pair of continuous side rails to which are coupled a plurality of equidistantly spaced cross-links, the individual fastener comprising a pair of shortened cross-bars that are interconnected by at least one flexible filament, the device comprising:

(a) a head assembly adapted to receive the supply of fastener stock, sever an individual fastener from the supply fastener stock and eject the individual fastener during a single stroke of its actuation cycle, wherein the head assembly can be disposed between a first setting configured to dispense a single fastener from the supply of fastener stock and a second setting configured to dispense a double fastener from the supply of fastener stock, the double fastener comprising a pair of shortened cross-bars that are interconnected by at least two flexible filaments, (b) a stepper motor for driving the head assembly through each head assembly actuation cycle, and (c) an electronic controller programmed to regulate the number of strokes completed by the head assembly during each head assembly actuation cycle, the electronic controller being programmed to include single stroke, multiple stroke, and continuous mode actuation cycle settings.

2. The device as claimed in claim 1 wherein the controller regulates the application of power to the stepper motor.

3. The device as claimed in claim 1 wherein the controller is programmed to count the number of strokes executed by the head assembly during a period of time.

4. The device as claimed in claim 1 further comprising an externally accessible data port in electrical connection with the controller.

5. The device as claimed in claim 1 wherein the controller provides means for incorporating an optional delay between successive strokes of the head assembly actuation cycle when the controller is disposed in either its multiple or continuous stroke mode actuation cycle setting.

6. The device as claimed in claim 5 wherein the length of the optional delay between successive strokes is adjustable.

7. The device as claimed in claim 1 wherein the controller provides means for varying the speed in which the head assembly completes each stroke of its actuation cycle.

8. The device as claimed in claim 1 wherein the device is adapted to receive alternating current (AC) power from an input power source that falls within the range of approximately 90 volts and 250 volts.

9. The device as claimed in claim 8 further comprising a DC power switching supply in electrical connection with the controller, the DC power switching supply converting the AC power from the input power source to a designated direct current (DC) power level prior to its application to the stepper motor.

10. The device as claimed in claim 1 wherein the head assembly comprises, (a) a head slidably coupled to a fixed mount, the head being driven by the stepper motor, (b) a pair of hollowed needles fixedly coupled to the head, each of the pair of hollowed needles being shaped to define a longitudinal bore and a narrow longitudinal slot in communication with the longitudinal bore, (c) a feed mechanism for advancing each side rail of the supply of fastener stock into direct axial alignment behind the longitudinal bore of a corresponding hollowed needle;

(d) a severing mechanism for separating an individual fastener from the supply of ladder stock, and (e) an ejection mechanism for ejecting each cross-bar of the individual fastener axially through the longitudinal bore of a corresponding hollowed needle.

11. The device as claimed in claim 10 wherein each needle is mounted in a corresponding needle holder, the pair of needles being arranged such that the longitudinal slots for the pair of needles are disposed in-line with one another.

12. The device as claimed in claim 10 wherein the severing mechanism comprises:

(a) a flattened knife blade slidably mounted on the fixed mount; and (b) a spring assembly for continuously urging the flattened knife blade in planar contact against the fixed mount.

13. The device as claimed in claim 12 wherein the spring assembly includes:

(a) a lever which is coupled to the head and which extends through an opening formed in the flattened knife blade;

(b) an enlarged stop formed onto the free end of the lever; and (c) a spring axially mounted on the lever, the spring continuously urging the flattened knife blade in contact against the fixed mount.

14. The device as claimed in claim 1 further comprising a user interface in electrical connection with the controller, wherein operation of the controller is regulated using the user interface.

15. The device as claimed in claim 14 wherein the user interface includes a digital display panel and one or more control buttons.

16. The device as claimed in claim 1 further comprising an exterior housing which includes a recess that is sized and shaped to receive at least a portion of a reel of the supply of continuously connected fastener stock.

17. The combination of:

(a) a length of continuously connected fastener stock; and (b) a device for dispensing an individual plastic fastener from the supply of fastener stock, the device comprising:

(i) a head assembly adapted to receive the supply of fastener stock, sever an individual fastener from the supply fastener stock and eject the individual fastener during a single stroke of its actuation cycle, wherein the head assembly can be disposed between a first setting configured to dispense a single fastener from the supply of fastener stock and a second setting configured to dispense a double fastener from the supply of fastener stock, the double fastener comprising a pair of shortened cross-bars that are interconnected by at least two flexible filaments.

(ii) a stepper motor for driving the head assembly through each head assembly actuation cycle, and (iii) (c) an electronic controller programmed to regulate the number of strokes completed by the head assembly during each head assembly actuation cycle, the electronic controller being programmed to include single stroke, multiple stroke, and continuous mode actuation cycle settings.

18. The combination as claimed in claim 17 wherein the fastener stock comprises a pair of continuous side rails to which are coupled a plurality of equidistantly spaced cross-links.

19. A one-piece plastic fastener for use with a fastener dispensing device, the one-piece plastic fastener comprising:

(a) a first cross-bar of uniform transverse cross-section along the entirety of its length;

(b) a second cross-bar;

(c) a flexible filament extending transversely between the first and second cross-bars, the flexible filament comprising a first end formed onto the first cross-bar and a second end formed onto the second cross-bar;

(d) wherein the first end of the filament is branched so as to connect to the first cross-bar at two or more separate points of contact.

20. The fastener as claimed in claim 19 wherein the first end of the filament is bifurcated.

21. A one-piece plastic fastener for use with a fastener dispensing device, the one-piece plastic fastener comprising:

(a) a first cross-bar of uniform transverse cross-section along the entirety of its length;

(b) a second cross-bar;

(c) a flexible filament extending transversely between the first and second cross-bars, the flexible filament comprising a first end formed onto the first cross-bar and a second end formed onto the second cross-bar;

(d) wherein the first end of the filament is branched so as to connect to the first cross-bar at two or more separate points of contact;

(e) wherein the second end of the filament is branched so as to connect to the second cross-bar at two or more separate points of contact.

22. A device for dispensing an individual plastic fastener from a supply of fastener stock, the fastener stock being shaped to include a pair of continuous side rails to which are coupled a plurality of equidistantly spaced cross-links, the individual fastener comprising a pair of shortened cross-bars that are interconnected by at least one flexible filament, the device comprising:

(a) a head assembly adapted to receive the supply of fastener stock, sever an individual fastener from the supply fastener stock and eject the individual fastener during a single stroke of its actuation cycle, wherein the head assembly can be disposed between a first setting configured to dispense a single fastener from the supply of fastener stock and a second setting configured to dispense a double fastener from the supply of fastener stock, the double fastener comprising a pair of shortened cross-bars that are interconnected by at least two flexible filaments, (b) a stepper motor for driving the head assembly through each head assembly actuation cycle, and (c) an electronic controller for regulating both of the following stepper motor operations: the variable stroke speed that the stepper motor drives the head assembly through each head assembly actuation cycle and the number of strokes that the stepper motor drives the head assembly through each head assembly actuation cycle.

* * * * *